US005335700A

United States Patent [19]

Ishido et al.

[11] Patent Number: 5,335,700

[45] Date of Patent: Aug. 9, 1994

[54] WEFT PICKING SYSTEM FOR A FLUID JET LOOM INCLUDING A ROLLER TYPE TRACTION DEVICE

[75] Inventors: Takao Ishido; Akio Shindo; Shuichi Kojima; Shuichiro Imamura; Kimimasa Onishi; Hiroshi Tsugane, all of Tokyo; Takashi Ogasawara, Tsukui; Kenichi Nakjima; Masahiro Adachi, both of Tokyo, all of Japan

[73] Assignee: Nissan Motor Co., Ltd., Yokohama City, Japan

[21] Appl. No.: 29,661

[22] Filed: -Mar. 10, 1993

[30] Foreign Application Priority Data

| | | | |
|---|---|---|---|
| Mar. 24, 1992 | [JP] | Japan | 4-065535 |
| Mar. 24, 1992 | [JP] | Japan | 4-065536 |
| Oct. 8, 1992 | [JP] | Japan | 4-269024 |
| Dec. 28, 1992 | [JP] | Japan | 4-347897 |

[51] Int. Cl.[5] ..... D03D 47/34

[52] U.S. Cl. ..... 139/435.1; 139/116.2; 139/450; 139/452

[58] Field of Search ..... 139/452, 450, 435.1, 139/116.2

[56] References Cited

U.S. PATENT DOCUMENTS

| | | | |
|---|---|---|---|
| 4,559,976 | 12/1985 | Araki et al. | 139/452 |
| 5,154,209 | 10/1992 | Takegawa | 139/452 |

FOREIGN PATENT DOCUMENTS

| | | | |
|---|---|---|---|
| 3714826 | 6/1988 | Fed. Rep. of Germany | 139/450 |
| 42-13571 | 8/1942 | Japan . | |
| 51-19860 | 2/1976 | Japan . | |
| 51-58563 | 5/1976 | Japan . | |
| 55-098941 | 7/1980 | Japan . | |
| 57-500250 | 2/1982 | Japan . | |
| 57-199841 | 12/1982 | Japan | D03D 47/34 |
| 235552 | 9/1988 | Japan | 139/116.2 |
| 02-053936 | 2/1990 | Japan . | |
| 02-175950 | 7/1990 | Japan . | |
| 02-175951 | 7/1990 | Japan . | |
| 02-175952 | 7/1990 | Japan . | |
| 02-175953 | 7/1990 | Japan . | |
| 03-70279 | 3/1991 | Japan . | |

*Primary Examiner*—Andrew M. Falik
*Attorney, Agent, or Firm*—Foley & Lardner

[57] ABSTRACT

A weft picking system for an air jet loom provided with a microcomputer as a controller. The weft picking system comprises a weft traction device including a pair of rollers one of which is driven by an inverter motor. A weft yarn fed from a weft measuring and storing device can be put between the rollers to be drawn toward a weft posture regulating nozzle. The weft posture regulating nozzle is arranged to project the weft yarn into the shed of warp yarns while regulating the posture of the weft yarn, under the influence of an air jet ejected therefrom and under assistance of air ejection from a plurality of sub-nozzles. The rollers are always driven to rotate during a weaving operation of the loom. A change-over device is provided to change the weft yarn from a first state of being put between the rollers to a second state of separating from the rollers or vice versa. The changing from the second state to the first state of the weft yarn is made after the starting of ejection of the fluid jet from the weft posture regulating nozzle in a weft picking cycle thereby preventing the weft yarn from being slackened in a location between the weft traction device and the weft posture regulating nozzle.

27 Claims, 25 Drawing Sheets

1
1'
401
402
403
404
405
406
407
10
11
13
14
15
30
31
33
50
51
52
71
72a
81
87,88
89
90
91
92
93
28B
T
Y
E
406a
406b
406c
52a

WEFT PICKING SYSTEM FOR A FLUID JET LOOM INCLUDING A ROLLER TYPE TRACTION DEVICE

BACKGROUND OF THE INVENTION

1. Field of the Invention

This invention relates to improvements in a fluid jet loom, and more particularly to a weft picking system including a roller type weft traction device between a weft measuring and storing device and a fluid jet nozzle to draw a weft yarn at a high speed toward the fluid let nozzle.

2. Description of the Prior Art

Fluid jet looms are provided with a weft picking system which is arranged to accomplish a weft picking under the influence of a fluid jet ejected from a nozzle or nozzles. The weft picking system accomplishes weft picking at a high speed with the fluid jet, and therefore is highly advantageous from the view point of improving productivity of a fabric and availability of the loom. However, for example, in case of accomplishing the weft picking under the influence of an air jet, a weft yarn is pulled and flown under a frictional force between the air stream and the weft yarn, and therefore such a weft picking consumes a large amount of pressurized air consumption (or electric power), thus being problematic from an energy consumption viewpoint.

In view of the above, a weft picking system has been proposed to deal with the above energy consumption problem as disclosed, for example, in Japanese Patent Provisional Publication No. 57-199841. In this publication, a pair of rotating rollers are provided to be contactable and separable, in which a weft yarn is held between and drawn by the rollers particularly at the initial stage of a weft picking period at which pressurized air consumption is particularly high, thereby saving the air consumption.

Thus, although the above-discussed conventional weft picking system is considerably effective from the viewpoint of reducing energy consumption because a fluid jet nozzle is used only for regulating the weft yarn to be picked under the direct traction by the rollers, a variety of drawbacks have been encountered in the conventional weft picking system as discussed below.

That is, for example, in the case where a weft reaching sensor detects a short pick in the course of the weft picking, a controller immediately outputs a loom stop signal to stop the operation of the loom. If the operation of the loom which is making its high speed revolution is suddenly stopped, a strong shock is applied onto a reed and onto a shedding mechanism, providing problems in durability of the loom. In this regard, stopping of the loom operation is made at the weft picking timing in the next weaving cycle upon completion of the beating-up operation with the reed. Thus, although the revolution of the loom is continued to the next weft picking timing when the loom is stopped, unwinding of the weft yarn from a weft measuring and storing device can be prevented to disable the next weft picking from being made in order to facilitate removal of the failed or short-picked weft yarn.

At this time, the unwinding of the weft yarn is stopped in a condition of being kept between the rollers which still continue to rotate at a high speed by inertia, and therefore the weft yarn is unavoidably drawn by the rollers though the weft yarn is not unwound from the weft measuring and storing device. This unavoidably causes breakage of the weft yarn. It seems that the above problem can be solved by braking the rotating rollers. However, the weft traction device is required to be small-sized and therefore has rollers which are smaller in outer diameter. Additionally, the rollers are required to rotate at high speeds in case the loom is operated or revolved at high speeds. In view of these, in order to stop the rollers abruptly at a suitable timing, a braking device high in response and in braking force is required. This also causes problems in durability of the rollers and the braking device. Thus, it has been impossible to securely and abruptly stop the rotating rollers, thereby leaving the above problems unsolved.

In addition to the above case of failure in weft picking, the loom is required to be stopped, for example, for restoring breakage of a weft yarn and for periodic maintenance of the loom. In such a case, if the loom is stopped in a condition where the weft yarn is held between the rotating rollers, breakage of the weft yarn unavoidably occurs in the manner discussed above. Furthermore, in a condition where the weft yarn is held between the rollers, the weft yarn is being restrained by the rollers and therefore becomes a hindrance to the removal operation for the failed weft yarn and to the maintenance operation of the loom thereby degrading the operability of the loom.

SUMMARY OF THE INVENTION

It is an object of the present invention to provide an improved weft picking system for a fluid jet loom, which consumes less energy than prior art devices and which is used for preventing breakage of a weft yarn upon the stopping of the loom thereby improving the operability of the loom.

Another object of the present invention is to provide an improved weft picking system for a fluid jet loom, in which a weft yarn is drawn at a high speed and fed to a weft posture regulating nozzle under the action of a roller which is always rotating during operation of the loom, thereby rendering the unnecessary use of a roller braking device to abruptly stop the roller at a suitable timing.

A weft picking system according to the present invention is for a fluid jet loom and comprises a weft measuring and storing device for measuring a predetermined length of a weft yarn and storing it prior to a weft picking. A weft posture regulating nozzle is provided to regulate the posture of the weft yarn fed from the weft measuring and storing device and to be picked into the shed of warp yarns, under the influence of a fluid jet ejected therefrom. A weft traction device is disposed between the measuring and storing device and the weft posture regulating nozzle and includes a rotatable roller. The weft yarn can be in press contact with the roller to make a traction action of the weft traction device to the weft yarn. The weft yarn from the measuring and storing device is drawn to the weft posture regulating nozzle under the traction action. The roller is always rotating during a weaving operation of the loom. A change-over device is provided and takes a first state to cause the weft yarn to be brought into press contact with the weft traction device roller, and a second state to cause the weft yarn to separate from the weft traction device roller. Additionally, a controller is provided to control operation of the weft posture regulating nozzle and the change-over device. The controller is adapted to change the change-over device from the second state to the first state after starting of ejection of the fluid jet from the weft posture regulating nozzle in a weft picking cycle.

Thus, the weft yarn is drawn at a high speed by the roller which is always rotating and not required to be stopped, and therefore no strong and abrupt braking is necessary to be applied to the roller by virtue of employing the change-over device which causes the weft yarn to be brought into press contact with the roller or to be separated from the roller. Additionally, by virtue of controlling the timing of operation of the change-over device, the weft yarn is drawn by the weft traction device after the air jet ejection from the weft posture regulating nozzle is made, thereby preventing the weft yarn from slackening (in the generally Z-shape) between the weft traction device and the west posture regulating nozzle. It is to be noted that slackening will cause the weft yarn to be caught by the weft posture regulating nozzle so as to raise a failed weft picking and/or a weave defect in the woven fabric. Furthermore, the weft yarn can separate from the roller of the weft traction device so as to be released from the restraint of the weft traction device, as for example, when the loom is stopped or when a failure in weft picking occurs. This greatly facilitates a removal operation of the failed weft yarn and a maintenance operation of the loom.

BRIEF DESCRIPTION OF THE DRAWINGS

In the drawings, like reference numerals designate like elements and parts throughout all the figures, in which:

FIG. 10A-1 to 10I are schematic illustrations showing an operational manner of the failed-weft yarn removing device of FIG. 7;

DETAILED DESCRIPTION OF THE INVENTION

Figure 1:
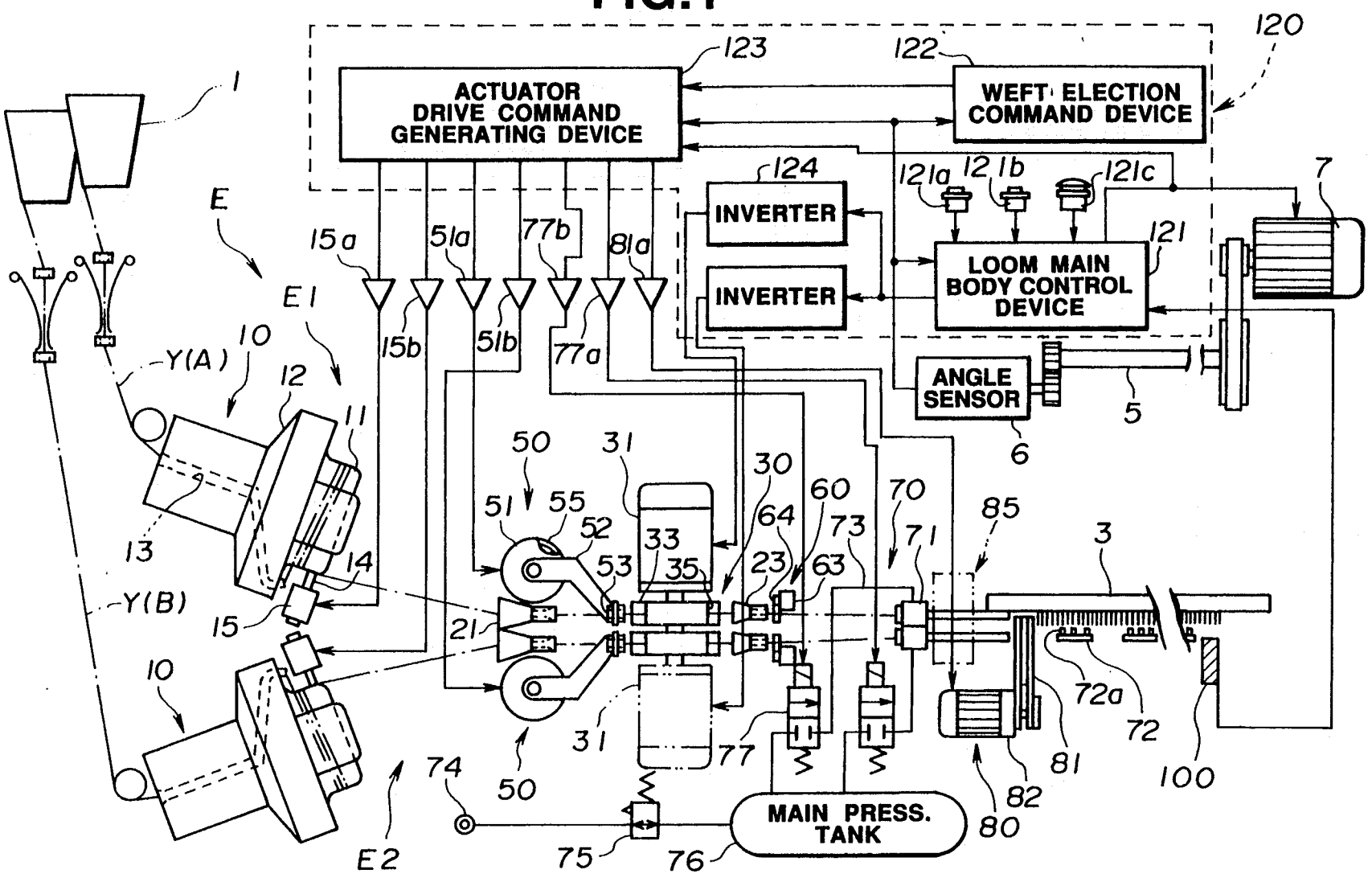
FIG. 1 is a schematic plan view illustration of a first embodiment of a weft picking system in accordance with the present invention.

Referring now to FIG. 1 of the drawings, a first embodiment of a weft picking system according to the present invention is illustrated by the reference numeral E. The weft picking system of this embodiment is for an air jet loom and comprises two weft picking systems E1, E2 one (E1) of which is for a weft yarn Y having color A, and the other E2 being for a weft yarn Y having color B. The color B is different from color A. The two weft picking systems E1, E2 are the same in structure, and therefore explanation will be made only on the weft picking system E1 for the weft yarn having color A.

The weft picking system E1 comprises a weft measuring and storing device 10 for measuring and storing a predetermined length of the weft yarn Y supplied from a yarn supply member 1. The weft yarn Y from the weft measuring and storing device 10 is guided by a yarn guide 21 and fed to a weft traction device 30 which is arranged to draw or drive the weft yarn Y under a weft engaged condition at which the weft yarn Y is put between two rollers 33, 35 of the weft traction device 30. Under a weft disengaged condition at which the weft yarn Y is released from the two rollers 33, 35, the weft yarn Y is not drawn or driven. A change-over device 50 is disposed between the yarn guide 21 and the weft traction device 30 and arranged to change over the weft yarn Y from the weft engaged condition to the weft disengaged condition, or vice versa. In other words, the change-over device 50 takes an engaging state at which the weft yarn Y is put at the weft engaged condition of the weft traction device 30, and a disengaging state at which the weft yarn Y is put at the weft disengaged condition of the weft traction device 30. The weft yarn Y drawn or driven from the weft traction device 30 is guided by a yarn guide 23 and fed to a fluid ejection device 70.

A weft braking device 60 is disposed between the yarn guide 23 and the fluid ejection device 70 to be able to provide a running resistance to the weft yarn Y. The fluid ejection device 70 is adapted to cause the weft yarn Y from the weft braking device 60 to fly through the shed of warp yarns (not shown) regulating the posture of the weft yarn Y, under the influence of pressurized air or an air jet ejected from it, thereby accomplishing a weft insertion or picking. The fluid ejection device 70 includes a weft posture regulating nozzle 71 for regulating the posture of the weft yarn Y from the braking device 60 under the influence of the air jet ejected therefrom. A cutting device 80 is disposed close to the fluid ejection device 70 to cut the weft yarn Y at a position between a woven cloth (not shown) and the air ejection device 70. A failed-weft yarn removing device 85 is provided to remove a failed weft yarn (Y) under cooperation of the cutting device 80. A weft reaching sensor 100 is disposed at a counter-weft picking side which is opposite to a weft picking side at which the weft posture regulating nozzle 71 is disposed, with respect to the woven cloth. The weft reaching sensor 100 is adapted to detect the reaching of the weft yarn Y flying through the warp shed to the counter-weft picking side. Additionally, a controller 120 is provided to control the operations of the above respective devices. The controller 120 forms part of a microcomputer.

Each of the above respective devices will be discussed in detail also with reference to FIGS. 2 to 6.

The weft measuring and storing device 10 includes a main body 12 having a drum (drum-shaped member) 11. A weft winding arm 13 is rotatably supported by the main body 12 and rotatingly driven by a motor (not shown) disposed inside the main body 12. The weft yarn Y passes through the inside of the weft winding arm 13 and wound by its predetermined length on the peripheral surface of the drum 11 and stored thereon. The weft yarn Y stored on the drum il is engaged with an engaging pin 14 which is inserted into the peripheral surface of the drum 11 and which extends toward the yarn guide 21. The engaging pin 14 is connected to a solenoid 15 and therefore is electromagnetically operated. The engaging pin 14 is adapted to be withdrawn from the periphery of the drum 11 upon energization of the solenoid under electric current supply, thereby disengaging from the weft yarn Y so as to allow the weft yarn Y to unwind from the drum 11. This initiates a weft picking through the warp shed. When the solenoid 15 is deenergized under no electric current supply, the engaging pin 14 is projected or inserted into the periphery of the drum 11 under the action of a spring (not shown) thereby preventing the weft yarn Y from unwinding from the drum 11. This terminates the weft picking. It will be understood that the solenoid 15 is adapted to be restored to its original state (at which the engaging pin 14 is projected) upon deenergization and therefore is called self-restored type of soleniod. The energization and de-energization of the solenoid 15 are controlled in response to a signal from the controller 120.

Figure 2:
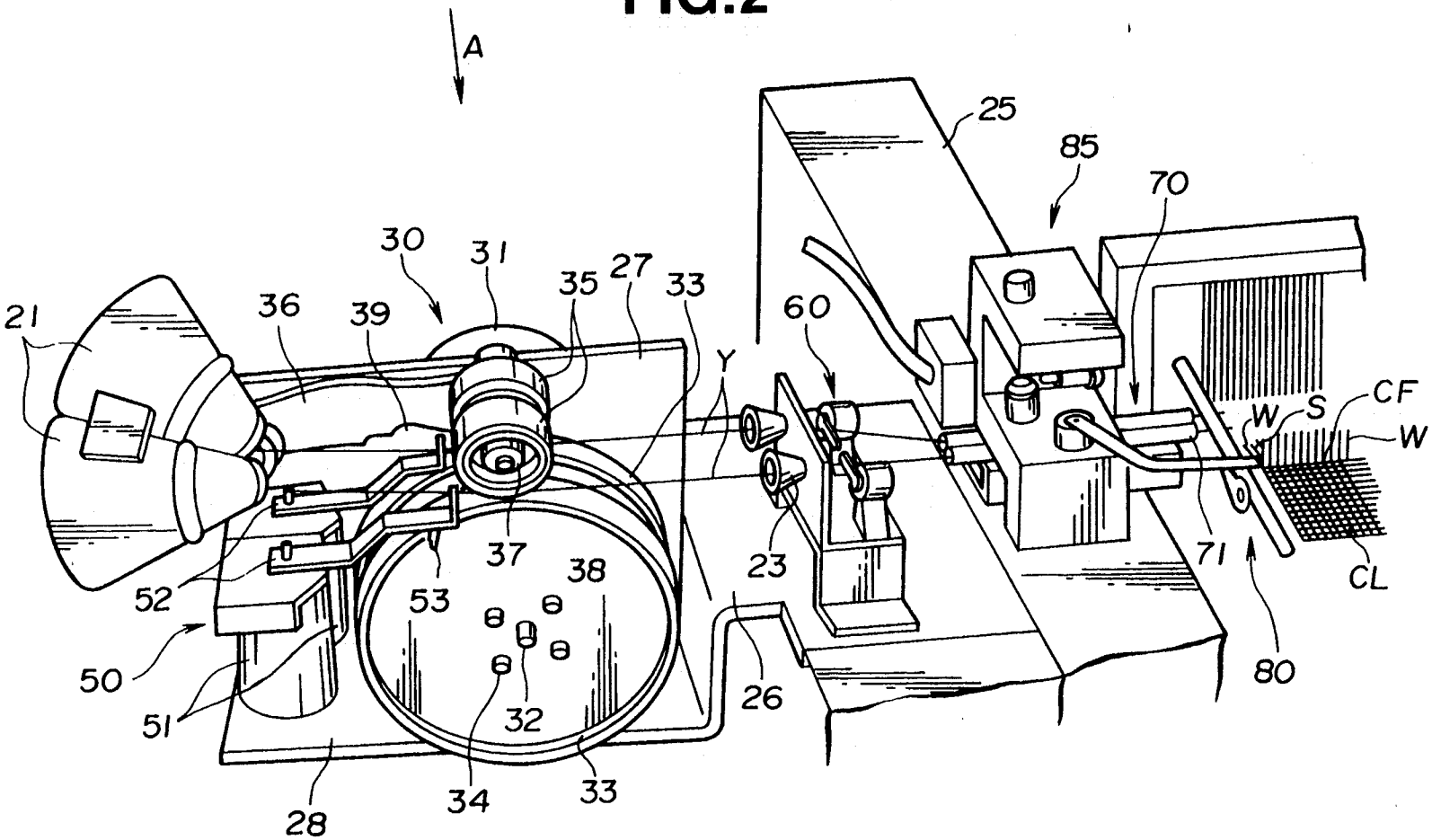
FIG. 2 is a perspective view of an essential part of the weft picking system of FIG. 1.

The yarn guide 21, the change-over device 50, the weft traction device 30, the yarn guide 23, and the weft braking device 60 are installed on a stationary base 26 which extends laterally and outwardly from a side frame 25 of the loom as shown in FIG. 2.

Each of the yarn guides 21, 23 is formed generally pipe-shaped and has an upstream (relative to moving direction of the weft yarn) inner diameter which is larger than its downstream inner diameter, so that the inner diameter gradually decreases in a direction from the upstream side to the downstream side. Thus, the yarn guide 21, 23 function to guide the weft yarn Y to a predetermined position at the device located downstream thereof with respect to the weft yarn moving direction.

The weft traction device 30 is installed on the stationary base 26 as shown in FIG. 2 and discussed above. More specifically, as shown in FIG. 2, a motor 31 for the weft traction device 30 is installed to a vertical wall 27 of the stationary base 26 and has a power output shaft (not shown) to which a driving shaft 32 is connected. The driving shaft 32 projects generally parallel with the side frame 25 as shown in FIG. 2. Two large diameter rollers 33 made of metal are fixedly coaxially mounted on the driving shaft 32. The two rollers 33 have respective cylindrical peripheral sections (no numeral) which are the same in outer diameter. The two rollers 33 are located so that they are separated a predetermined distance from each other in the axial direction of the driving shaft 32 and fixed to the driving shaft 32 through screws 34.

A small diameter roller 35 is disposed on or above each large diameter roller 35 and has an outer diameter smaller than that of the larger diameter roller 33. The small diameter roller 35 includes an inner roller member 37 which is made of metal and rotatably installed to a free end section of an arm 36. The arm 36 is vertically movably installed at its base end to the vertical wall 27. A rubber or elastomeric layer 38 is formed at the outer peripheral surface of the inner roller member 37. The small diameter roller 35 is biased against the outer peripheral surface of the large diameter roller 33 under the action of a tension spring 39 extended between the vertical wall 27 and the arm 36. Accordingly, the weft yarn Y is put and held between the rotating large and small diameter rollers 33, 35 and drawn forward under the weft engaged condition. Under the weft disengaged condition, the weft yarn Y is released from the position between the rotating rollers 33, 35, so that no traction force is applied to the weft yarn Y.

Figure 3:
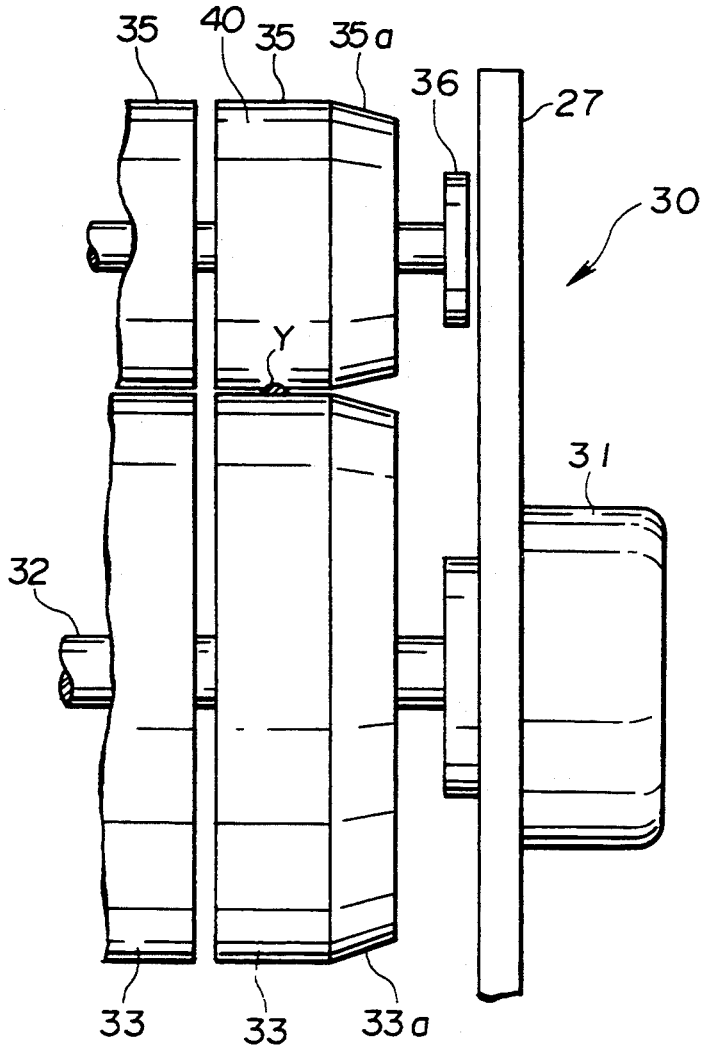
FIG. 3 is a fragmentary side view of a weft traction device forming part of the essential part of FIG. 2.
Figure 4:
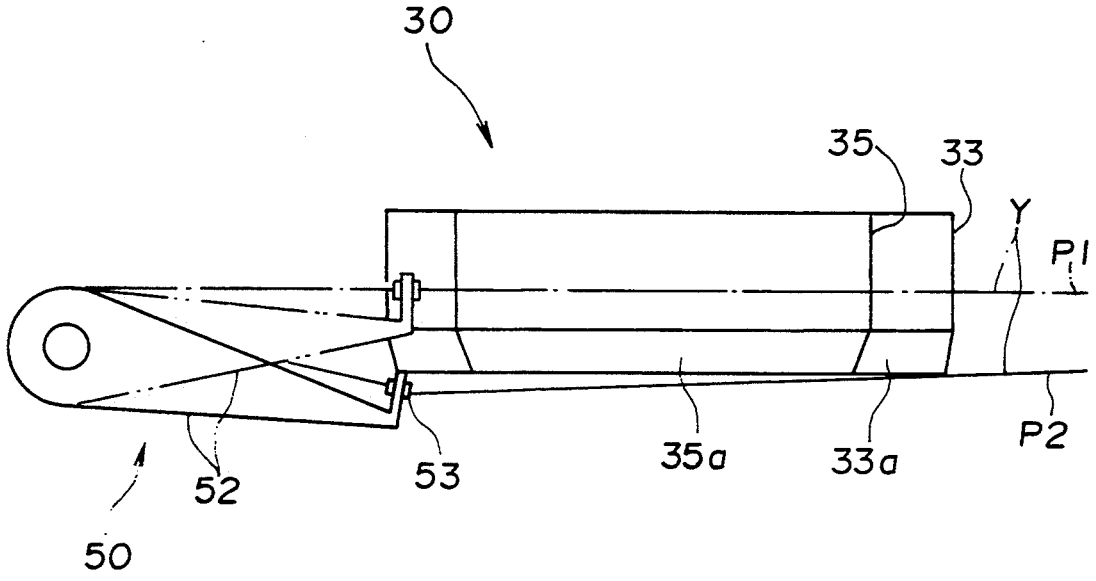
FIG. 4 is a fragmentary plan view of the traction device as viewed from a direction indicated by an arrow A in FIG. 2.
Figure 5:
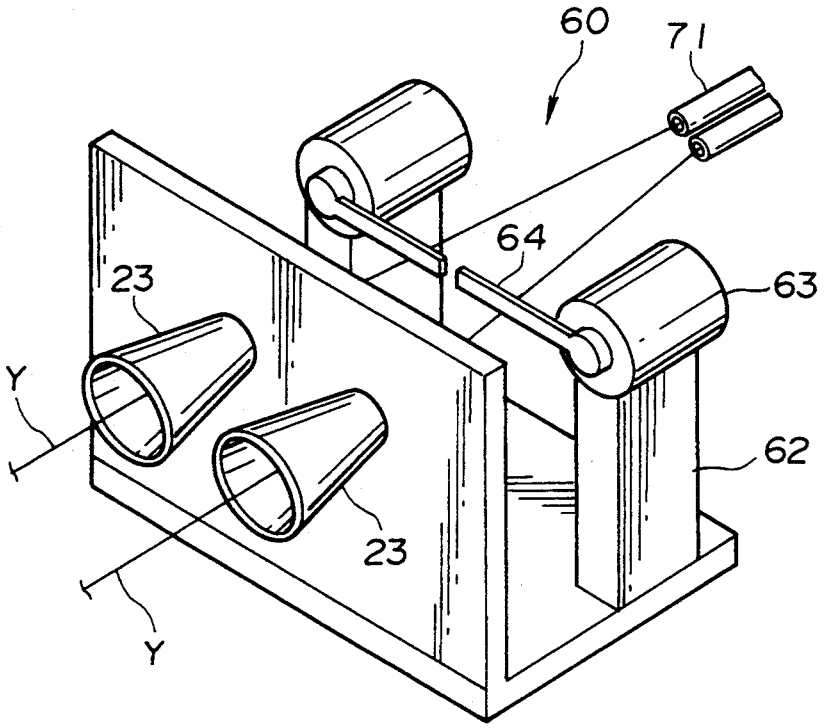
FIG. 5 is a fragmentary perspective view of a weft braking device forming part of the essential part of FIG. 2.

FIG. 3 shows a state in which the weft yarn Y is put between the rollers 33, 35 so that the traction force of the roller 33 is transmitted to the weft yarn Y. In this state, the peripheral surface of the small diameter roller 35 is in press contact with that of the large diameter roller 33, in which the driving force of the large diameter roller 33 driven by the motor 31 is transmitted to the small diameter roller 35 so that the rollers 33, 35 rotate at the same peripheral speed and in reverse directions relative to each other. The rubber layer 38 of the small diameter roller 35 is in contact with the weft yarn and therefore formed of a soft rubber or elastomeric material such as polyurethane rubber in order to increase the frictional force of the roller 35 relative to the weft yarn Y. It is to be noted that the peripheral surface of each roller 33, 35 is tapered or formed frustoconical at one end section 33*a*, 35*a* through which the weft yarn Y is displaced into or out of the position between the peripheral surfaces of the large and small diameter rollers 33, 35 under the action of the change-over device 50, as shown in FIGS. 3 and 4. It will be understood that the thus formed tapered peripheral surface end section 33*a*, 35*a* facilitates the weft yarn displacement action into or out of the position between the facing rollers 33, 35.

While the two large diameter rollers 33 have been shown and described as being rotatingly driven by the single motor 31, it will be appreciated that they may be rotatingly driven respectively by two separate motors. The facing rollers 33, 35 may be rotatingly driven respectively by separate driving sources. The two large diameter rollers 33 may have outer diameters different from each other, and the small diameter rollers 35 may have outer diameters different from each other.

The change-over device 50 includes a rotary solenoid 51 having a power output shaft (no numeral). The rotary solenoid 51 is adapted to be energized under supply of electric current, thereby rotatingly driving the power output shaft in one direction. Under no electric current supply to the rotary solenoid 51, the rotary solenoid 51 is deenergized so that the power output shaft is rotated in the reverse direction under the biasing force of a spring 55. Thus, the rotary solenoid 51 is electromagnetically operated and is of the self-restoring type wherein the power output shaft is returned to its original position under the biasing force of the spring 55. The rotary solenoid 51 is secured on a bottom wall 28 of the stationary base 26. A traverse lever 52 is fixedly mounted on the power output shaft of the rotary solenoid 51, and arranged to rotatingly move around the axis of the power output shaft. The free end section of the traverse lever 52 is movably located near a location at which the large and small diameter rollers 33, 35 are contacted to each other. The free end section of the traverse lever 52 is bent upwardly to form an upwardly extending tip end portion (no numeral) which is formed with a weft yarn insertion hole 53 through which the weft yarn Y is passed.

FIG. 4 shows two operational states of the weft traction device 30, i.e., the weft engaged condition indicated by broken lines and the weft disengaged condition indicated by solid lines. When the traverse lever 52 of the. change-over device 50 is being stopped at its original position indicated by the solid lines in FIG. 4 under the self-restoring function of the rotary solenoid 51, the weft yarn Y is on a displaced weft path P2 which is displaced from a normal weft path P1, so that the weft yarn Y gets out of the position between the rollers 33, 35 thereby establishing a no traction condition in which no traction force is applied to the weft yarn Y. When the traverse lever 52 is moved from the original position to its position indicated by the broken lines upon energization of the rotary solenoid 51, the weft yarn Y is returned on the normal weft path P1 so as to be put into the position between the rollers 33, 35 thereby establishing a traction condition in which a traction force is applied to the weft yarn Y. As discussed before, since the tapered peripheral surface end sections 33*a*, 35*a* are formed respectively in the rollers 33, 35, the change-over operation for the weft yarn Y between its disengaged position indicted by the solid lines and its engaged position indicated by the broken lines is facilitated.

The weft braking device 60 is disposed on the downstream side of the yarn guide 23 with respect to the weft yarn running direction and located close to the yarn guide 23. The weft braking device 60 includes a bracket 62 installed on the stationary base 26. A rotary solenoid 63 of the electromagnetically operated and self-restored type (like the rotary solenoid 51) is installed on the bracket 62 and has a power output shaft (not shown) on which a rod-like operating arm 64 is fixedly mounted and located near the yarn guide 23.

Figure 6:
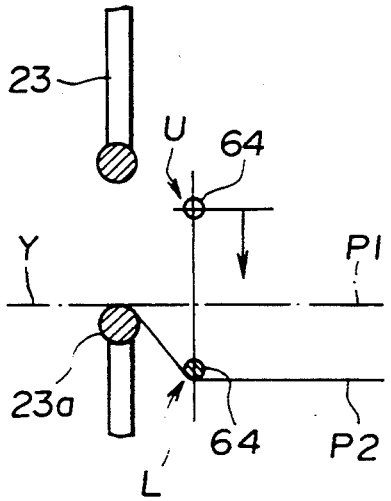
FIG. 6 is an explanatory view of the weft braking device of FIG. 5, showing an operational manner of the weft braking device.

When the rotary solenoid 63 is not being energized upon receiving no signal from the controller 120, it is rotatingly biasing the operating arm 64 downwardly under the bias of a spring (not shown) or under the self-restored function so that the operating arm 64 displaces from its upper position U to its lower position L as shown in FIG. 6. Accordingly, the weft yarn Y is pressed downwardly to take the displaced path P2, in which the weft yarn Y is brought into press contact with the inner peripheral edge 23*a* of the yarn guide 23. As a result, a running resistance is applied to the weft yarn Y. When the rotary solenoid 63 is energized upon receiving the signal from the controller 120, the operating arm 64 is rotatingly forced upwardly to be displaced from the lower position L to the upper position U in FIG. 6, so that the operating arm 64 becomes separate from the weft yarn Y. At this time, the weft yarn Y is displaced from the displaced path P2 to the normal path P1. It will be understood that the weft braking device 60 may be located on an upstream side of the yarn guide 23 with respect to the weft yarn running direction.

The fluid ejection device 70 includes a weft posture regulating nozzle 71 which is supplied with pressurized air from a pressurized air supply line 73. The pressurized air supply line 73 includes a main pressure tank 76 which is connected through a pressure reducing valve 75 to a pressurized air supply source 74. The air-outlet side of the main pressure tank 76 is connected to the weft posture regulating nozzle 71 via an electromagnetically operated valve 77 of the self-restored type wherein the valve takes an original state when a solenoid (not shown) is deenergized. The valve 77 is adapted to open or close in response to a signal from the controller 120, thereby allowing the weft posture regulating nozzle 71 to make or stop ejection of air jet. Under this air jet ejection, the weft yarn drawn from the weft traction device 30 and threaded in the weft posture regulating nozzle 70 is regulated in posture and picked into the shed S of warp yarns W so as to fly toward the counter-weft picking side.

A plurality of sub-nozzle groups 72 are mounted on a reed 3 of the loom and located on the side of the cloth fell CF of the woven cloth CL. The sub-nozzle groups 72 are arranged along the shed S of the warp yarns W. Each sub-nozzle group 72 includes a plurality of sub-nozzles 72*a*, five sub-nozzle groups in this embodiment.

Each sub-nozzle group includes three sub-nozzles 72*a* as shown in FIG. 1. The sub-nozzles 72*a* of the respective sub-nozzle groups 72 are supplied with pressurized air from a pressurized air supply line (not shown) which includes a relief valve (not shown) connected to the pressurized air supply source 74. The relief valve is connected to a constant pressure tank (not shown) which is connected to a plurality of the electromagnetically operated and self-restored type valves (not shown but similar in construction to the valve 77) which are respectively connected to the sub-nozzle groups 72. The plural valves corresponding to the respective sub-nozzle groups 72 are successively opened in a direction from the weft picking side to the counter-weft picking side in response to respective signals output from the controller 120, in which each valve is opened during a predetermined time (valve opening time). This allows the respective sub-nozzle groups 72 to make relay-ejection of pressurized air in a manner to follow the tip end section of the weft yarn Y projected from the weft posture regulating nozzle 71. By virtue of such relay-ejection of pressurized air, the weft yarn Y flies through an air guide passage (not shown) formed in the reed 3 and located inside the warp shed, and reaches to the counter-weft picking side thereby accomplishing the weft picking or insertion.

The cutting device 80 functions to cut the weft yarn Y beaten-up by the reed 3, and includes a cutter 81 which is fixedly secured near the side and the cloth fell of the woven cloth so as to extend in a fore-and-aft direction of the loom. The cutter 81 has upper and lower blades (no numerals). The lower blade of the cutter 81 is driven by a rotary solenoid 82 so as to make a cutting action for the weft yarn Y under incorporation of the upper blade.

The failed-weft yarn removing device 85 is for removing the weft yarn Y which has failed in weft picking (such as a mispicked weft yarn). The removing device 85 is disposed on the side frame 25 and located near the cloth fell of the woven cloth. The removing device 85 will be discussed in detail hereafter with reference to FIGS. 2 and 7.

The weft reaching sensor 100 is disposed on the counter-weft picking side with respect to a warp array (not shown) or the woven cloth, in order to detect a weft reaching timing at which the picked weft yarn has reached to the counter-weft picking side. The weft reaching sensor 100 outputs a signal representative of the weft reaching timing. An angle sensor 6 is provided to detect rotational angle positions of a main shaft 5 of the loom, and to output signals representative of the respective rotational angle positions. The output signals from the weft reaching sensor 100 and from the angle sensor 6 are fed to the controller 120.

In connection with these output signals, the controller 120 carries out the following control: First, the time at which the signal from the weft reaching sensor 6 has been input to the controller 120 is substituted with the rotational angle position detected by the angle sensor 6. A calculation is made to determine a difference between the detected weft reaching timing as the rotational angle position and a set weft reaching timing which has been previously preset as a standard value in the controller 120. With this difference, the moving or swinging timing (a traverse timing) of the traverse lever 52 of the change-over device 50 is corrected. This corrected swinging timing as a correction command is fed back to a set swinging timing (of the traverse lever 52) which has been determined in accordance with a revolution speed of the loom and a width of the cloth to be woven, the revolution speed and the cloth Width being input to the controller 120 by an operator during a preparation operation for a loom weaving operation. At this time, an electric current supply time (time duration) from an electric power source (not shown) to the rotary solenoid 51 is controlled thereby to regulate a time for which the traverse lever 52 of the change-over device 50 is being stopped at its weft engaging position for causing the weft yarn Y to be engaged with the rollers 33, 35 of the weft traction device 30.

The controller 120 includes a loom main body control device 121 which is electrically connected to a weft selection command device 122 and to an actuator drive command generating device 123. Thus, the devices 121, 122, 123 are mutually electrically connected with each other, in which the signal from the angle sensor 6 incorporated with the loom main shaft 5 is directly fed to the devices 121, 122, 123. Accordingly, the devices 121, 122, 123 make independently their operations in response to the signals from the angle sensor 6. The controller 120 further includes inverters 124 electrically connected to the loom main body control device 121.

The loom main body control device 121 includes a control section, a calculation section, a memory section, and an input section by which set values are manually input by an operator, though not shown. The loom main body control device 121 is electrically connected to a host computer (not shown) for controllably managing a plurality of looms (not shown). The loom main body control device 121 is constructed and arranged to generate loom operation signals thereby to control the starting and stopping of a loom main motor 7 (for driving the loom main shaft 5) and each inverter 124 for the motor 31 of the weft traction device 30. The operation of the loom main body control device 121 will be discussed in detail with reference to a time chart hereafter.

The loom main body control device 121 is provided with a ready button 121*a*, a start button 121*b*, and a stop button 121*c*. The ready button 121*a* is pushed to make an operation of the loom, in which, for example, a command is made to start the invertor 124 of the motor 31 which requires a time until it reaches a normal operational speed at which the weft traction device 30 can be normally operated. The start button 121*b* is pushed after the motor 31 has reached the normal rotational speed and after a signal representative of completion of preparation for loom operation starting has been output. Upon pushing this start button 121*b*, the loom main motor 7 is started. The stop button 121*c* is pushed to stop the loom operation and can be pushed at any time if required.

The weft selection command device 122 is arranged to command the actuator drive command generating device 123 to select the weft yarn Y which is to be used in the next weft picking cycle, in accordance with an order previously programmed, in case of a multiple color weaving in which a plurality of weft yarns having different colors are used. It will be understood that one weft yarn is picked in one weft picking cycle. In this embodiment in which one of the weft yarns Y is of color A and the other of color B, the weft selection command device 122, for example, designates to the actuator drive command generating device 123 that the weft yarn Y having color A is to be used at the next weft picking cycle. A signal representative of this designation has been already precedently output at about a main shaft rotational angle of about 300 degrees in the precedent weft picking cycle. Then, when the rotational angle has reached 300 degrees in the present weft picking cycle, for example, a signal representative of designation or selection of the weft yarn Y having color B as the weft yarn Y to be used in the next weft picking cycle is output. There are a variety of orders of the weft yarns having colors A and B such as A-B-B . . . or A-A-B-A-A-B . . . It will be understood that the above-mentioned precedent output of the designation is made for the purpose of preventing malfunctions due to a response delay of each actuator upon the selection of the weft yarn having been made.

The actuator drive command generating device 123 is arranged to successively operate the respective actuators through drivers (not shown). The actuators include an actuator 15*a* for operating the engaging pin 14 of the weft measuring and storing device 10 in the weft picking system E1, and an actuator 15*b* for operating the engaging pin 14 of the weft measuring and storing device 10 in the weft picking system E2. The actuators further include an actuator 51*a* for operating the traverse lever 52 of the change-over device 50 in the weft picking system E1, an actuator 51*b* for operating the traverse lever 52 of the change-over device 50 in the weft picking system E2, an actuator 77*a* for operating the valve 77 in the weft picking system E1, an actuator 77*b* for operating the valve 77 in the weft picking system E2, and an actuator 82*a* for operating the cutter 81 of the cutting device 80. In case of the multiple color weaving, the above actuators are selectively operated in accordance with the previously input programmed order of designation or selection of the respective plural weft yarns Y having different colors.

Figure 8:
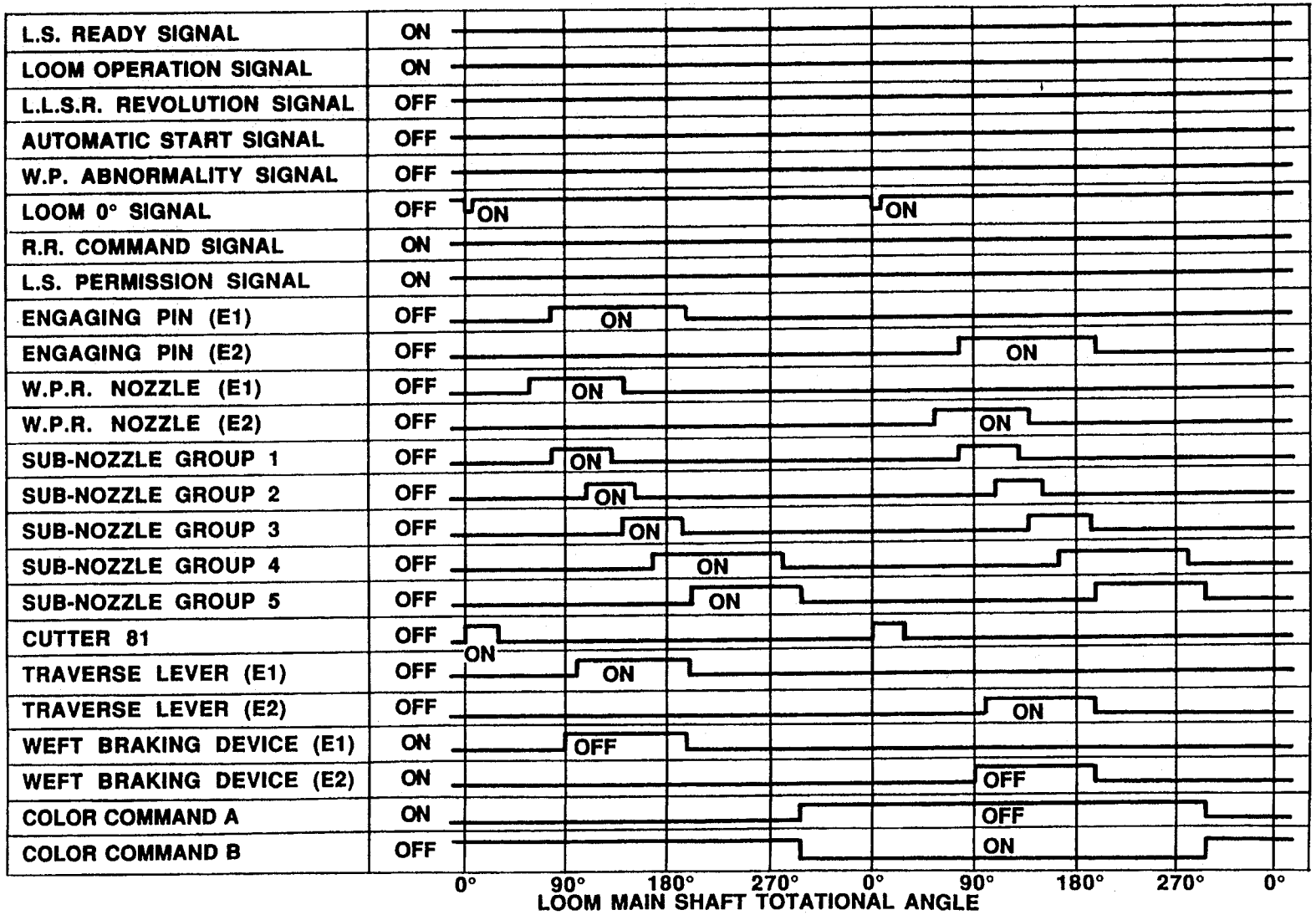
FIG. 8 is a time chart showing a control manner of the weft picking system of FIG. 1 in terms of a loom main shaft rotational angle, during a normal operation of the loom.

Next, the manner of operation of the weft picking system E of the present invention will be discussed with reference to the time chart in FIG. 8. The time chart shows operational states of the respective actuators in the case where the loom provided with the weft picking system E makes its steady state operation, in which operation of the actuators for the devices and items (listed at the left-most column) are illustrated in terms of the loom main shaft rotational angle. Although this time chart illustrates a case in which the weft yarns Y in the weft picking systems E1, E2 are alternately picked, the operations of the respective weft picking systems are fundamentally the same and therefore explanation will be made only on the weft picking system E1.

The devices and items listed at the left-most column in the time chart of FIG. 8 will be explained. A loom starting (L.S.) ready signal takes its ON state when the ready button 121*a* is pushed, thereby to supply electric power. When the loom ready signal takes its OFF state, the electric power supply is cut. Additionally, when the loom starting ready signal takes the ON state, a roller rotation (R.R.) command signal takes its ON state at which a command for starting the rotation of roller 33 is generated. When the roller rotation command signal takes its OFF state, the command is not generated. A loom operation signal takes its ON state when the start button 121*b* is pushed after a loom starting (L.S.) permission signal is changed to its ON state for permitting starting of the main motor 7. The loom starting permission signal takes the ON state when the rotational speed of the roller 33 has reached a predetermined level at which the weft traction device 30 normally functions. The loom operational signal takes its OFF state when the start button 121*b* is not pushed. The loom starting permission signal takes its OFF state for preventing the permission of starting of the main motor 7. A loom low speed reverse revolution (L.L.S.R.) signal takes its ON state for reversely rotating the loom main shaft 5 at a low speed, and its OFF state at which the reverse rotation of the loom main shaft 5 is not made. An automatic start signal takes its ON state at which the loom is automatically started, and its OFF state at which no automatic start of the loom is made. A weft picking (W.P.) abnormality signal takes its ON state when an abnormality (failure) in weft picking (such as mispick or short pick) is detected. The weft picking abnormality signal takes its OFF state when no abnormality in weft picking is detected. A loom 0 degree signal takes its ON state when the rotational angle of the loom main shaft 5 is at 0 degree. The loom 0 degree signal takes its OFF state when the loom main shaft rotational angle is not 0 degree. The "engaging pins (E1), (E2)" indicate respectively those 14 in the weft picking systems E1 and E2. Each engaging pin 14 takes its ON state to be projected to the drum 11 so that the weft yarn Y is engaged with the engaging pin, and its OFF state to be withdrawn from the drum 11 so that the weft yarn Y is disengaged from the engaging pin. The "weft posture regulating nozzles (E1), (E2)" indicate respectively those 71 in the weft picking systems E1, E2. The "sub-nozzle groups 1, 2, 3, 4, 5" indicate respectively groups 72 of the sub-nozzles 72*a* which groups are arranged in the mentioned order in a direction from the weft picking side to the counter-weft picking side. Each nozzle takes its ON state to eject air jet, and its OFF state at which no air jet ejection is made. The "traverse levers (E1), (E2)" indicate respectively those 52 in the weft picking systems E1, E2. Each traverse lever 52 takes its ON state at which the weft yarn Y receives the traction force or action of the weft traction device 30, and its OFF state at which the weft yarn Y is released from the traction action of the weft traction device 30. The "weft braking devices (E1), (E2)" indicates respectively those 60 in the weft picking systems E1, E2. Each weft braking device 60 takes its ON state for applying its braking action to the weft yarn Y, and its OFF state for releasing the weft yarn Y from the braking action. Color commands A, B represent respectively generations of commands for selecting the weft yarns having colors A and B. Accordingly, the command corresponds to the signal representative of the designation of the weft yarn having color A or B. When the color command takes its ON state, the weft yarn having the corresponding color is selected. No such selection is made at its OFF state.

At a timing immediately before the main shaft rotational angle reaches 0 degree at which the beating-up operation is made by the reed 3, the tip end section of the weft yarn Y has reached the counter-weft picking side. At this time, the weft yarn Y is being engaged with the engaging pin 14 so as not to be picked, in which the weft posture regulating nozzle 71 has not yet ejected an air jet. The rollers 33, 35 of the weft traction device 30 are rotating; however, and the weft yarn Y is on the displaced path P2 (See FIG. 4) and therefore released from the traction action of the weft traction device 30, i.e., the weft yarn is in the no traction condition. The braking device 60 is operated to apply the braking action to the weft yarn Y. At a timing at which the loom main shaft rotational angle has exceeded 0 degree, the cutting device 80 operates to cut the weft yarn Y.

When the loom main shaft rotational angle has reached 60 degrees, the weft posture regulating nozzle 71 starts ejection of air jet; however, the weft yarn Y cannot fly or be projected from the weft posture regulating nozzle 71. Subsequently, the engaging pin 14 is withdrawn from the drum 11, and therefore the weft yarn Y is projected from the weft posture regulating nozzle 71 to start its flight. Immediately after this, the braking device 60 is released so that the weft yarn Y is released from the braking action of the weft braking device 60. Simultaneously, the traverse lever 52 of the change-over device 50 is operated to form the normal path P1 (See FIG. 4) on which the weft yarn Y is brought into the position between the rollers 33, 35. Accordingly, the weft yarn Y receives the traction force from the rollers 33, 35 and is therefore drawn at a predetermined high speed toward the counter-weft picking side, thus putting the weft yarn in the traction condition. Then, the weft yarn Y makes its flight toward the counter-weft picking side upon being regulated in posture. The flight of the weft yarn Y is made through the air guide channel formed in the reed 3 upon being supported by air jets ejected from the sub-nozzles 72*a* arranged along the air guide channel. When a unwinding sensor (not shown) disposed near the engaging pin 14 detects a predetermined number of unwound turns of the weft yarn Y wound on the drum 11, the engaging pin 14 is immediately projected to the drum 11 so as to be brought into its engagement position at which the weft yarn is engaged with the engaging pin 14 whereby the waft yarn is stopped in its flight toward the counter-weft picking side. When about one turn of winding of the weft yarn Y has been made after the time the engaging pin 14 is brought into its engagement position, the weft yarn Y is substantially engaged with the engaging pin 14 thereby terminating the weft picking.

Before the weft yarn Y is actually brought into engagement with the engaging pin 14, the traverse lever 52 changes the path of the weft yarn Y from the normal path P1 (in the traction condition) to the displaced path P2 (in the no traction condition) thereby releasing the weft yarn Y from the traction action of the weft traction device 30. Simultaneously, the weft braking device 60 comes to its operating condition to apply the braking action to the weft yarn Y. As a matter of fact, a peak tension is applied to the weft yarn Y when the weft yarn Y is actually brought into engagement with the engaging pin 14; however, the peak tension is suppressed to a considerably lower value under the braking action of the braking device 60 which is optimally adjusted to obtain an optimum braking force to the predetermined flight speed of the weft yarn Y. The reaching of the weft yarn Y to the counter-weft picking side is detected by the weft reaching sensor 100, and a detection signal representative of the weft reaching is input to the controller 120.

Subsequently, the operational states of the loom provided with the weft picking system E will be discussed with reference to a time chart of FIG. 9 in which operation of the actuators for the devices and items (listed at the left-most column) are illustrated in terms of a time period during from a stop and a start of the loom.

First, the ready button 121*a* for starting the loom is pushed so that the loom starting ready signal is changed to its ON state from its OFF state. The time at which the ready button 121*a* is pushed is assumed to be t1. Simultaneously with this button pushing, the roller rotation command signal (for making the command of rotation of the roller 33) is changed to its ON state from its OFF state, thereby causing the roller 33 to rotate through the inverter 124. At this time, the loom starting permission signal for permitting the starting of the loom is changed from its ON state to its OFF state in which the loom starting is not permitted. That is to say, the loom starting is not permitted until the rotational speed of the roller 33 reaches the predetermined level. This is because a mispick will occur if the rotational speed of the roller 33 is lower than the predetermined level. The loom starting permission signal takes its ON state at a time t2 when it is confirmed that a predetermined time has been lapsed from the time t1 or the rotational speed of the roller 33 has reached the predetermined level. Then, the start button 121*b* is pushed manually, for example, at a time t3 thereby starting the weaving operation of the loom. The above operations are in a loom normal weaving operation.

Next, the operation of the weft picking system E in the case of the occurrence of a failure in weft picking will be discussed mainly with reference to FIGS. 7 to 10I.

First, the failed-weft yarn removing device 85 will be explained with reference to FIG. 7. First and second air blow-up nozzles 87, 88 are disposed on a reed support body (not shown) on which the reed 3 is fixedly mounted. The air blow-up nozzles 87, 88 are adapted to blow up pressurized air or an air jet in a direction indicated by an arrow in FIG. 7. A transferring arm 89 of the generally L-shape is fixed on the power output shaft of a motor (no numeral) disposed on the frame 86 which is fixedly mounted on the loom side frame 25. Accordingly, the transferring arm 89 is rotatable around the axis of the motor power output shaft. An air mover (or a suction and ejection pipe) 90 and a pair of take-up rollers 91, 92 are provided to draw the weft yarn Y carried by the transferring arm 89. Additionally, a suction device 93 connected to a blower (not shown) is provided to finally treat the failed weft yarn Y from the take-up rollers 91, 92.

Figure 7:
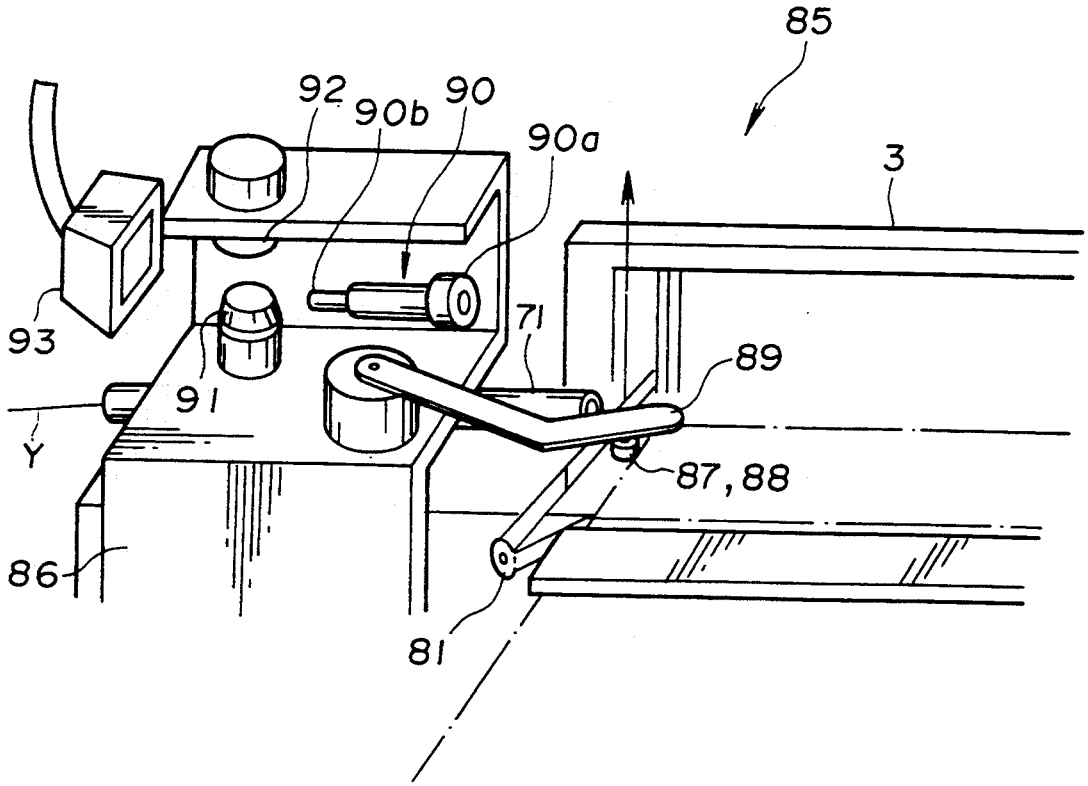
FIG. 7 is a fragmentary perspective view of a failed-weft yarn removing device forming part of the essential part of FIG. 2.

The transferring arm 89 functions to hook the weft yarn Y blown up in the direction of the arrow in FIG. 7 under the action of air ejected from the blow-up nozzles 87, 88, and carry it to the inlet 90*a* of the air mover 90. The air mover 90 is arranged to eject air from the inside thereof to the outlet 90*b* thereof thereby sucking the weft yarn Y in the inlet 90*a* and ejecting it from the outlet 90*b*. The take-up rollers 91, 92 are disposed near the outlet 90*b* of the air mover 90 and arranged such that one of the rollers 91, for example, 92 is supported rotatable and vertically movable under the action of an air cylinder (not shown). The roller 92 is downwardly pushed by the air cylinder and brought into contact with the other roller 91 so that the weft yarn Y is securely held between the rollers 91, 92. Then, the roller 91 is rotated by a motor (not shown) and therefore the rollers 91, 92 rotate as a single body thereby taking up the weft yarn thereon. Thereafter, the roller 92 is moved upward and therefore separates from the roller 91 so that the weft yarn Y is released from the rollers 91, 92. Then, the suction device 93 sucks the weft yarn Y from the take-up rollers 91, 92 and discharges it out of the loom.

When a mispick or failure in weft picking occurs, the weft reaching sensor 100 detects the mispick and generates the detection signal representative of the mispick to be input to the loom main body control device 121. Then, the loom operation signal for commanding operation of the loom is changed from its ON state to its OFF state. In other words, a loom stop signal for commanding stopping of loom operation is generated. When this loom stop signal is input to the actuator drive command generating device 123, the operation of the actuator 51*a* (or 51*b*) is stopped. Accordingly, electric current supply to the rotary solenoid 51 is stopped to deenergize the rotary solenoid 51, so that the rotary solenoid 51 self-restores under the bias of the spring 55. As a result, the traverse lever 52 of the change-over device 50 transfers the weft yarn Y on the displaced path P2, thus releasing the weft yarn Y from the rollers 33, 35 of the traction device 30.

After generation of the stop signal, electric current supply to the rotary solenoid 51 is not made, and therefore the traverse lever 52 is maintained at its releasing position at which the weft yarn is released from the rollers 33, 35. Simultaneously with input of the loom stop signal to the actuator drive command signal generating device 123, electric current supply to the actuator 82*a* for operating the cutting device 80 is stopped so as to prevent the cutting action of the cutting device 80.

The loom continues to operate or revolve by inertia even after the loom stop signal is generated, and then stops at a loom main shaft rotational angle of around 100 to 180 degrees at the weft picking period of the next weaving cycle. However, the next weft picking will not be made.

Figures 1, 10A:
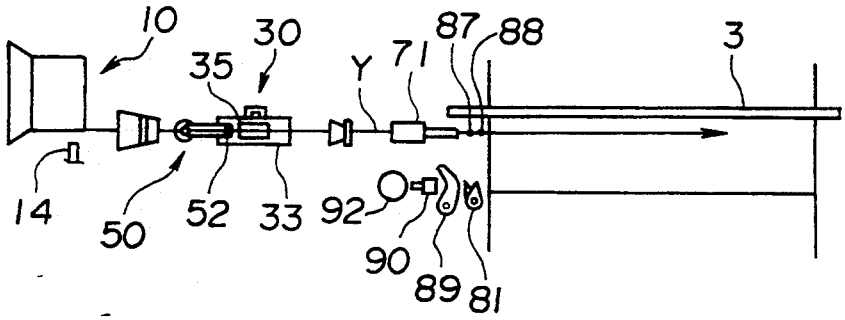
Figures 2, 10A:
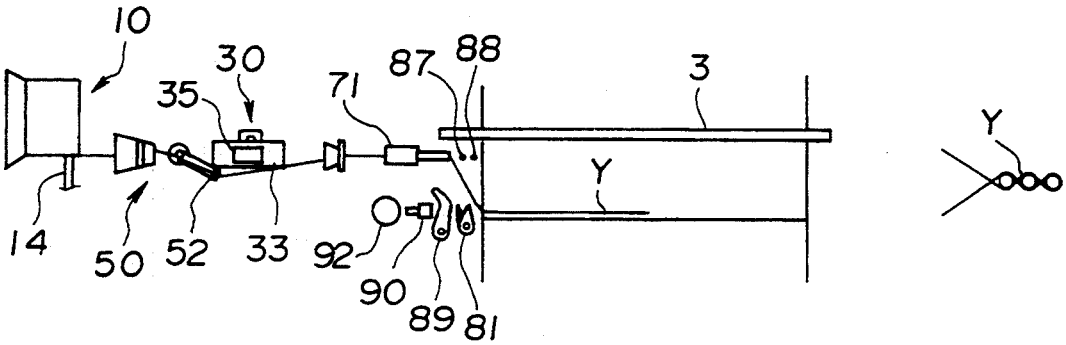
Figure 10B:
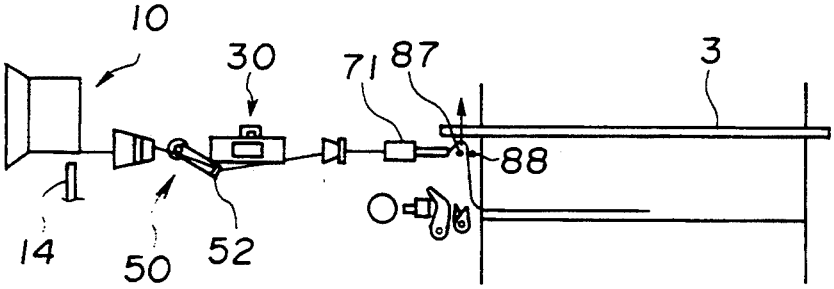
Figure 10C:
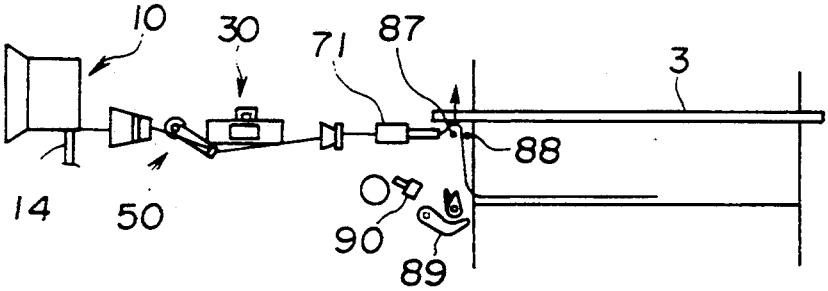

Removal of the failed weft yarn Y (such as a mispicked weft yarn) will now be discussed. The loom main shaft 5 of the stopped loom is positioned at a rotational angle at a predetermined stopping position, for example, 180 degrees. FIG. 10A-1 shows a time at which a short pick occurs. FIG. 10A-2 shows a state in which the loom is stopped upon the failed or short pick weft yarn Y being woven with the warp yarns. Then, as shown in FIGS. 10B and 10C, the engaging pin 14 is withdrawn, and the weft yarn Y in an amount corresponding to one turn on the drum 11 is unwound from the drum 11 under the action of air which is always ejected slowly from the weft posture regulating nozzle 71. When the unwinding of the one turn we#t yarn Y is detected by the weft unwinding sensor (not shown) disposed on the weft measuring and storing device 10, the engaging pin 14 is projected to the outer periphery of the drum 11. Then, the blowing-up nozzles 87, 88 are operated to blow up air, and therefore the failed weft yarn Y extending from the weft posture regulating nozzle 71 and the vicinity of the cloth fell is blown up in the shape of a reversed U-shape under the influence of air blown up from the blow-up nozzles 87, 88.

Figure 9:
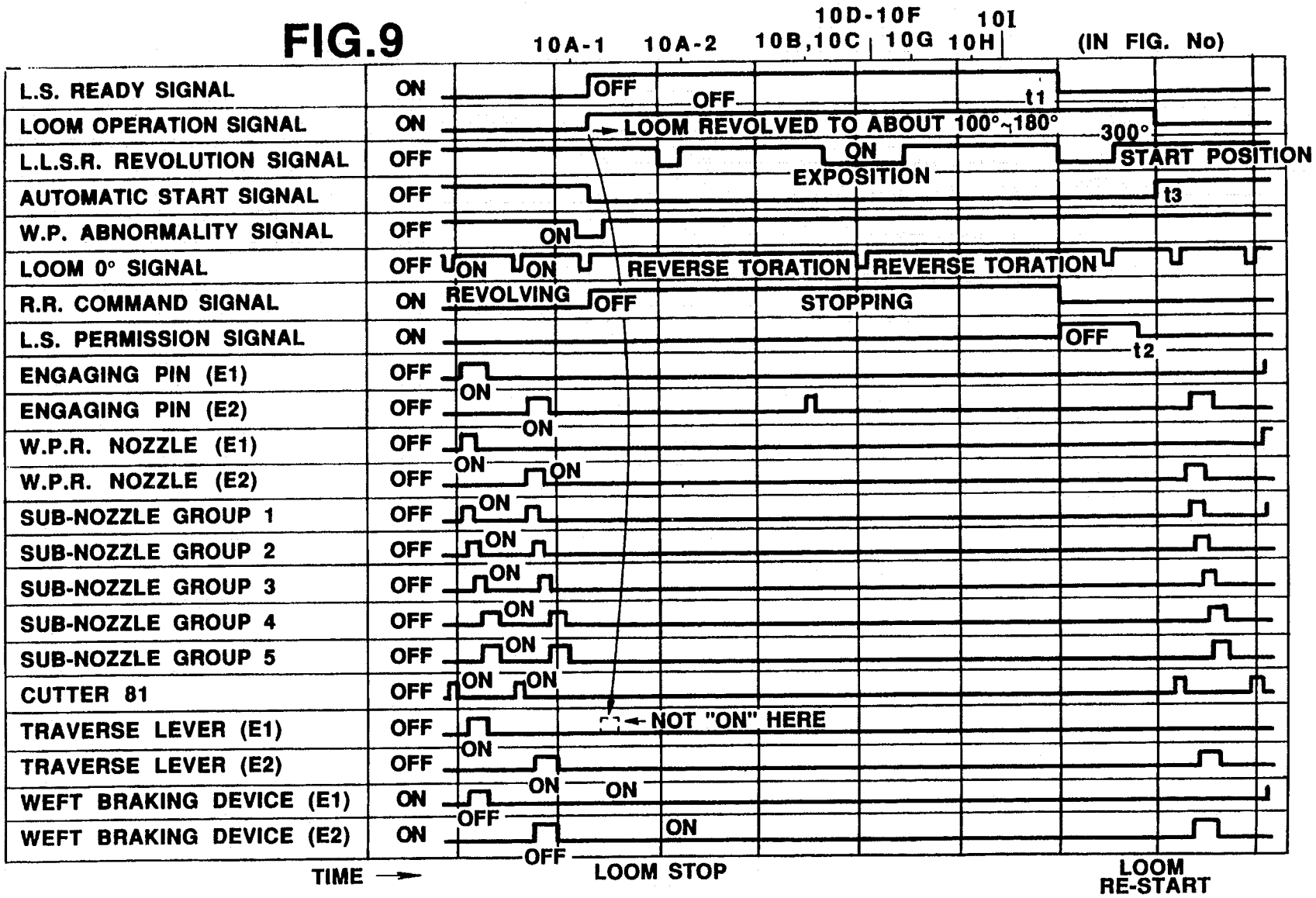
FIG. 9 is a time chart similar to that of FIG. 8 but showing a control operation of the weft picking system in terms of time, during a time period between stopping and re-starting of the loom.
Figure 10D:
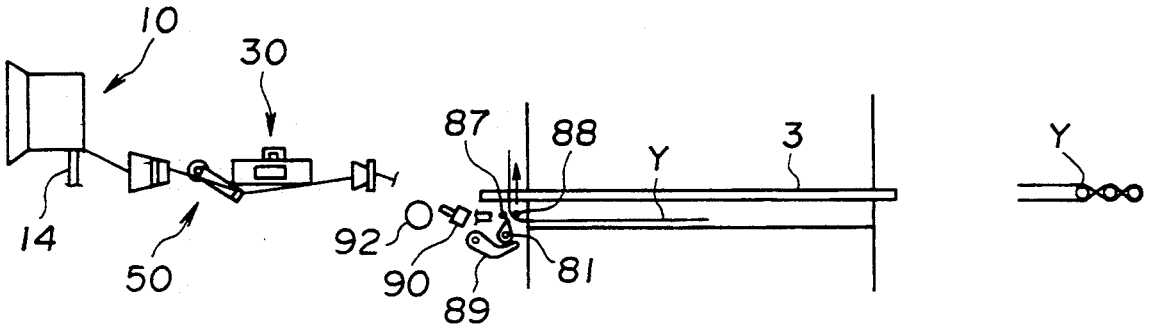
Figure 10E:
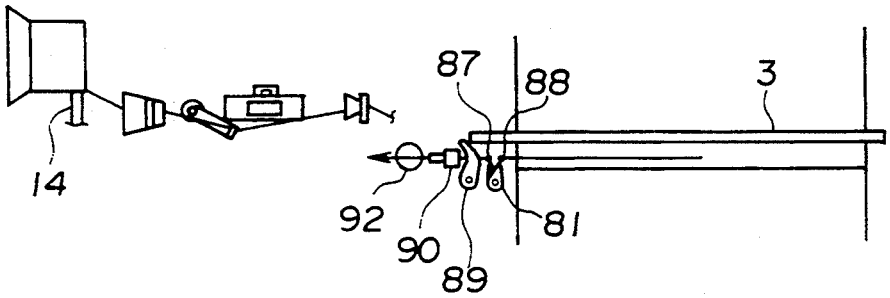
Figure 10F:
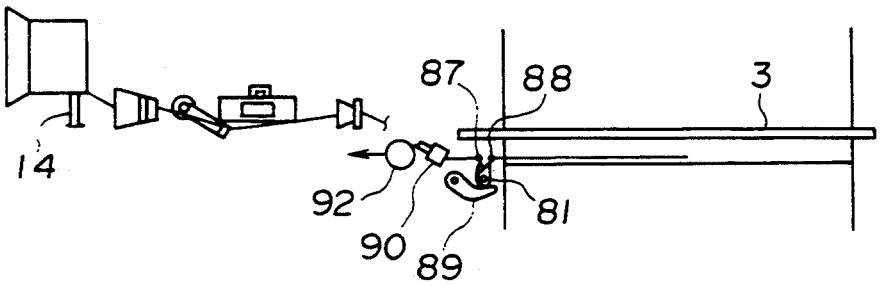
Figure 10G:
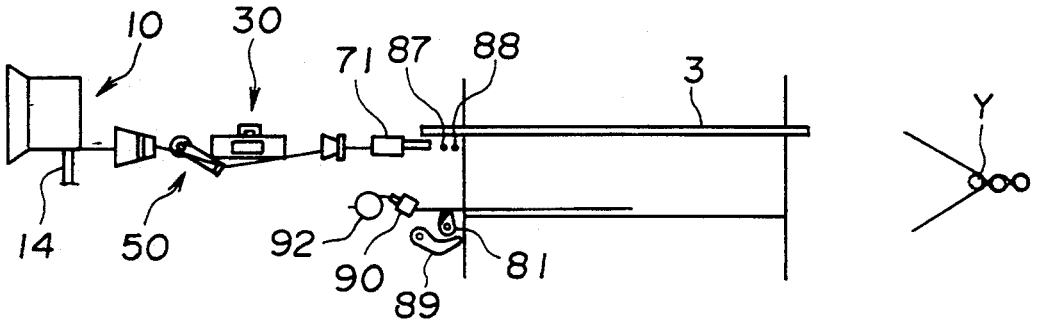
Figure 10H:
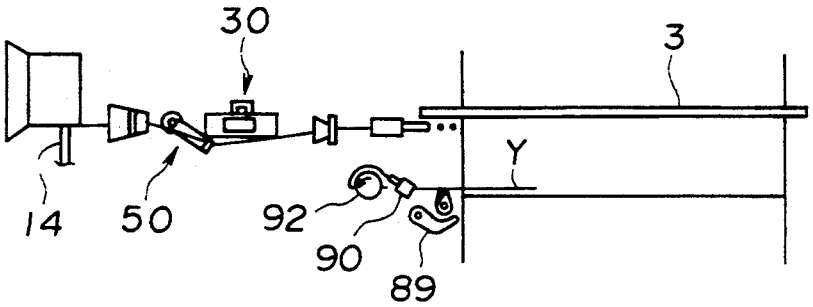
Figure 10I:
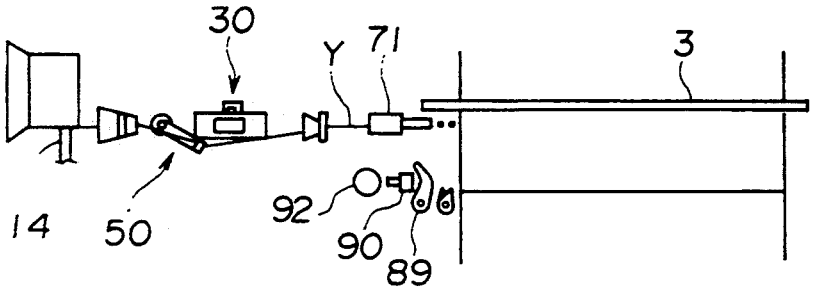

From this state, the loom main shaft is reversely rotated 180 degrees as shown in FIGS. 10D, 10E, 10F in which the reed 3 is moved to the vicinity of the cloth fell thereby allowing the failed weft yarn Y to be exposed at the cloth fell (called "exposition" as shown in FIG. 9). Here, the reversed U-shape weft yarn Y moving along a cutter guide extending from the upper blade of the cutter 81 is cut by the cutter 81, in which one end section of the cut weft yarn Y is connected to and supported by the weft posture regulating nozzle 71 while the other end section extends upwardly. Then, the transferring arm 89 is rotated to carry the weft yarn Y to the inlet 90*a* of the air mover 90. The air mover 90 sucks the weft yarn Y from the inlet 90*a* thereinto. Then, the take-up roller 92 is projected downwardly thereby to hold the weft yarn Y between the rollers 91, 92. Subsequently, the loom main shaft 5 is reversely rotated to establish a state shown in 10G and stopped in that position, and then the weft yarn Y is sucked to the air mover 90 upon rotation of the roller 91. Thus, the failed weft yarn Y is discharged through the suction device 93 to the outside of the loom. Thereafter, the loom main shaft 5 is reversely rotated, and the normal weaving operation is started from a loom main shaft rotational position at which a beating-up operation with the reed 3 is made on a weft yarn which has been picked previously by one pick relative to the failed weft yarn Y and is exposed at the cloth fell. The procedure of starting the loom proceeds as discussed above.

While the above discussion has been made relative to a multiple color loom, it will be understood that the principle of the present invention may be applied to other type looms. Additionally, it will be appreciated that the construction and the arrangement of the controller 120 and the failed-weft yarn removing device 85 not be limited to those shown and described in the above embodiment.

Figure 11:
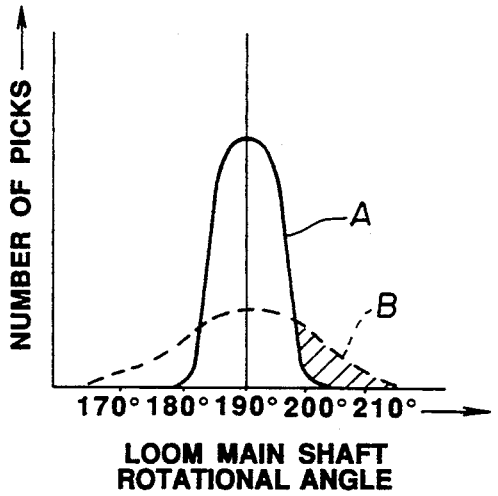
FIG. 11 is a graph showing advantageous effects obtained by the first embodiment weft picking system.

FIG. 11 shows advantageous effects of the first embodiment weft picking system (particularly of the weft traction device 30) in comparison with a conventional weft picking system in which a weft picking is accomplished only under the influence of air jets. The graph of FIG. 11 shows a distribution of the weft reaching timings (at which the weft yarn Y reaches the counter-weft picking side) in 1000 picks, in terms of the number of picks and the weft reaching timing (loom main shaft rotational angle). The distribution of FIG. 11 was experimentally measured. In FIG. 11, a curve A indicates the distribution of the embodiment of the present invention while a curve B indicates that of the conventional weft picking system.

As apparent from the graph of FIG. 11, the embodiment of the present invention has a very small width distribution as compared with the conventional weft picking system. This demonstrates the fact that the flying speed of the weft yarn in weft picking is very stable in the case of using the weft traction device 30 including the rollers 33, 35. Such a stable weft yarn flying speed allows a sufficiently high running resistance to be applied at a predetermined timing to the weft yarn by the weft braking device 60, and therefore the peak tension at engagement of the weft yarn Y with the engaging pin 14 is remarkably lowered. Additionally, by virtue of using the weft traction device 30 including rollers, it is sufficient that the weft posture regulating nozzle 71 and the sub-nozzles 72*a* function merely to maintain a suitable posture of the picked or flying weft yarn Y. Accordingly, the traction force due to fluid (air) is considerably minimized, which can lower the peak tension of weft yarn Y when the running resistance is applied to the weft yarn. As a result, the peak tension is reduced to about $\frac{1}{3}$ of that in the conventional weft picking system accomplishing weft picking only under the influence of air jets.

Figure 12:
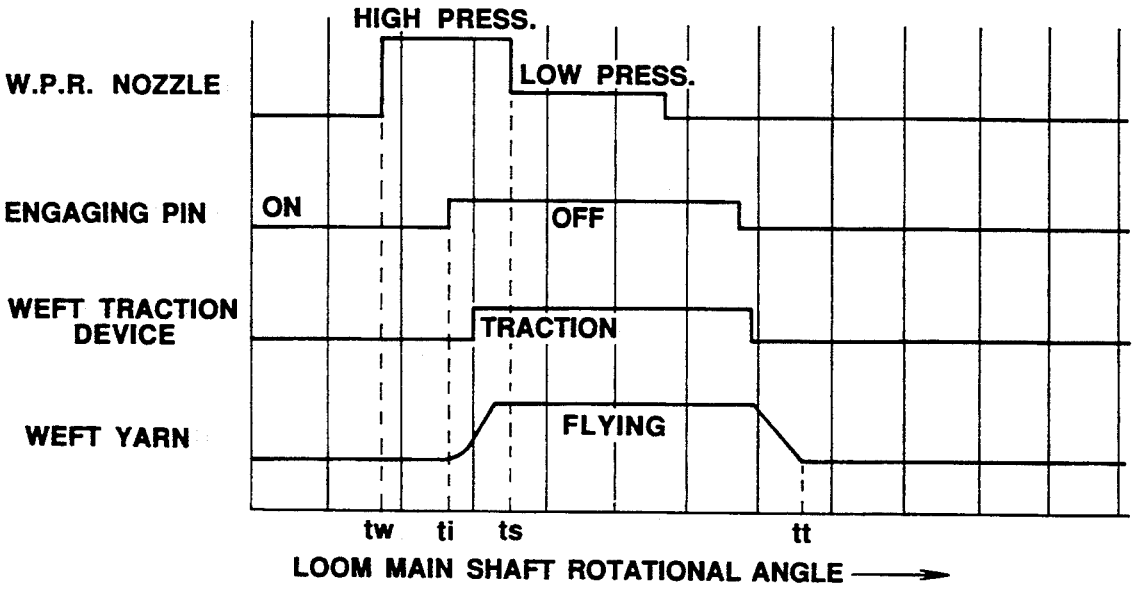
FIG. 12 is a time chart showing a part of the operation of a second embodiment of the weft picking system according to the present invention.

FIG. 12 illustrates a second embodiment of the weft picking system according to the present invention, which is similar to the first embodiment of FIGS. 1 to 10I. In this embodiment, the pressure (air ejection pressure) of air ejected from the weft posture regulating nozzle 71 is lowered during such an operation of the weft traction device 30 such that a traction force of the weft traction device 30 is applied to the weft yarn Y. More specifically, such lowering of the air ejection pressure of the weft posture regulating nozzle 71 is accomplished when or after a traction action by the upstream-most sub-nozzle group 72 (at left-most position in FIG. 1) is applied to the tip end section (the upstream-most end section) of the picked weft yarn Y.

The above will be explained with reference to the time chart of FIG. 12. The weft posture regulating nozzle 71 first ejects air at a high pressure value such as 6 kg/cm$^2$ at a timing or loom main shaft rotational angle tw. When a timing reaches ts at which the tip end section of the picked weft yarn Y is drawn by an air jet ejected from the upstream-most sub-nozzle group 72, the air ejection pressure of the weft posture regulating nozzle 71 is lowered to a low pressure value such as 2 kg/cm$^2$. It was experimentally confirmed that a normal weft picking was achieved under the above control of air ejection pressure control for the weft posture regulating nozzle 71. The low pressure value of the air ejection pressure may be 0 kg/cm$^2$,which was also experimentally confirmed to achieve a normal weft picking. In other words, even if the air ejection pressure of the weft posture regulating nozzle 71 is stopped after the traction action of the upstream-most sub-nozzle group 72 is applied to the weft yarn tip end section normal weft picking occurs. Additionally, it was also experimentally confirmed that a normal weft picking could be accomplished even if the above-lowering of the air ejection pressure of the weft posture regulating nozzle 71 is slightly earlier than the timing rs, or during application of the traction action of the weft traction device 30 to the weft yarn Y. It will be appreciated that lowering the air ejection pressure of the weft posture regulating nozzle 71 greatly saves pressurized air consumption and accordingly energy consumption, achieving a secure weft picking. In the time chart of FIG. 12, the "weft traction device" 30 is in its traction condition at a time period indicated in "traction" in FIG. 12. The "weft yarn" Y is flying in a time period between timings ti and tt in FIG. 12. The flight of the weft yarn Y is initiated at the timing ti and terminated at the timing tt.

Figure 13:
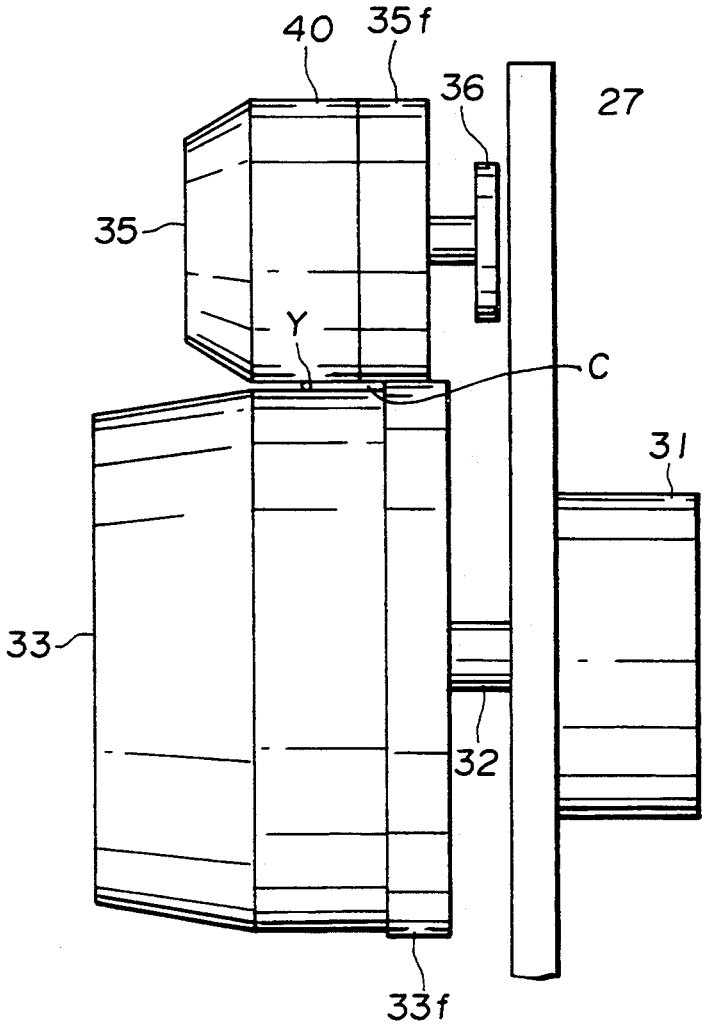
FIG. 13 is a fragmentary side view of the weft traction device forming part of the weft picking system of FIG. 12.

In this embodiment, the weft traction device 30 is arranged as shown in FIG. 13. The roller 33 is formed at its end section with a coaxial annular flange section 33*f* which is in press contact with a coaxial annular end section 35*f* which is different in material from the rubber layer 40. Accordingly, a slight clearance C is formed between the rollers 33, 35, in which the weft yarn Y is located in the clearance C in a manner that the traction force of the roller 33 is applied to the weft yarn Y. The clearance C has a dimension of 1/5 to ⅓ of the diameter of the weft yarn Y used. It will be understood that such an arrangement of the weft traction device 30 improves the durability of the rollers 33, 35.

Figure 14:
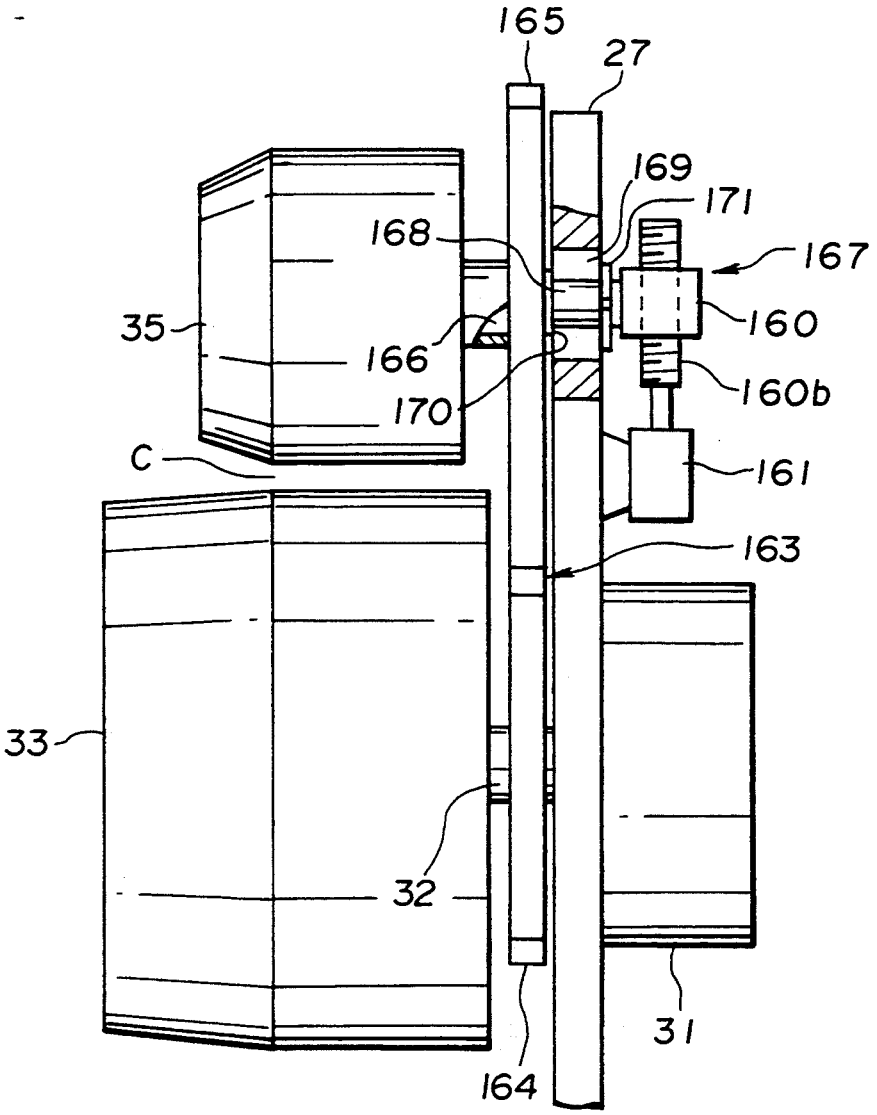
FIG. 14 is a fragmentary side view similar to FIG. 13 but showing the weft traction device forming part of a third embodiment of the weft picking system in accordance with the present invention.

FIG. 14 illustrates a part of a third embodiment of the weft picking system according to the present invention, which is similar to the first embodiment. The weft traction device 30 of this embodiment includes a power transmission mechanism 163 which includes a drive gear 164 fixedly mounted on the driving shaft 32. A driven gear 165 is in mesh with the drive gear 164, and fixedly mounted on an axial shaft 166 of the roller 35. The axial shaft 166 has a reduced diameter section 68 which is inserted in a vertically extending long hole 169 formed in the vertical wall 27. The reduced diameter section 68 is vertically movably supported to the vertical wall 27 under the action of a C-shaped or E-shaped ring 171 fitted therearound. The reduced diameter section 168 has a tip end section projecting from the ring 171. A nut-like member 160*a* having an internal thread (not shown) is fixedly attached to the tip end section of the reduced diameter section 168. The internal thread of the nut-like member 160*a* is in mesh with the thread of a bolt-like member 160*b* connected to the power output shaft of a motor 161 secured to the vertical wall 27.

Upon operation of the motor 161, the clearance C between the rollers 33, 35 can be adjusted within a range in which the gears 164, 165 are maintained in mesh with each other, thereby providing effective traction speed and time duration for the weft yarn Y.

In this embodiment, the controller 120 is arranged to accomplish the following operation: When the weft reaching sensor 100 detects the reaching timing (weft reaching timing) of the weft yarn Y to the counter-weft picking side, calculation is made to obtain a difference between the detected weft reaching timing and a preset weft reaching timing. Then, a correction command signal is supplied to either one of the motor 31 of the weft traction device 30 and the rotary solenoid 51 of the change-over device 50. The correction command signal is in accordance with the above-mentioned difference and is for controlling the traction of the weft traction device 30 in such a manner that the weft reaching timing becomes constant.

Figure 15:
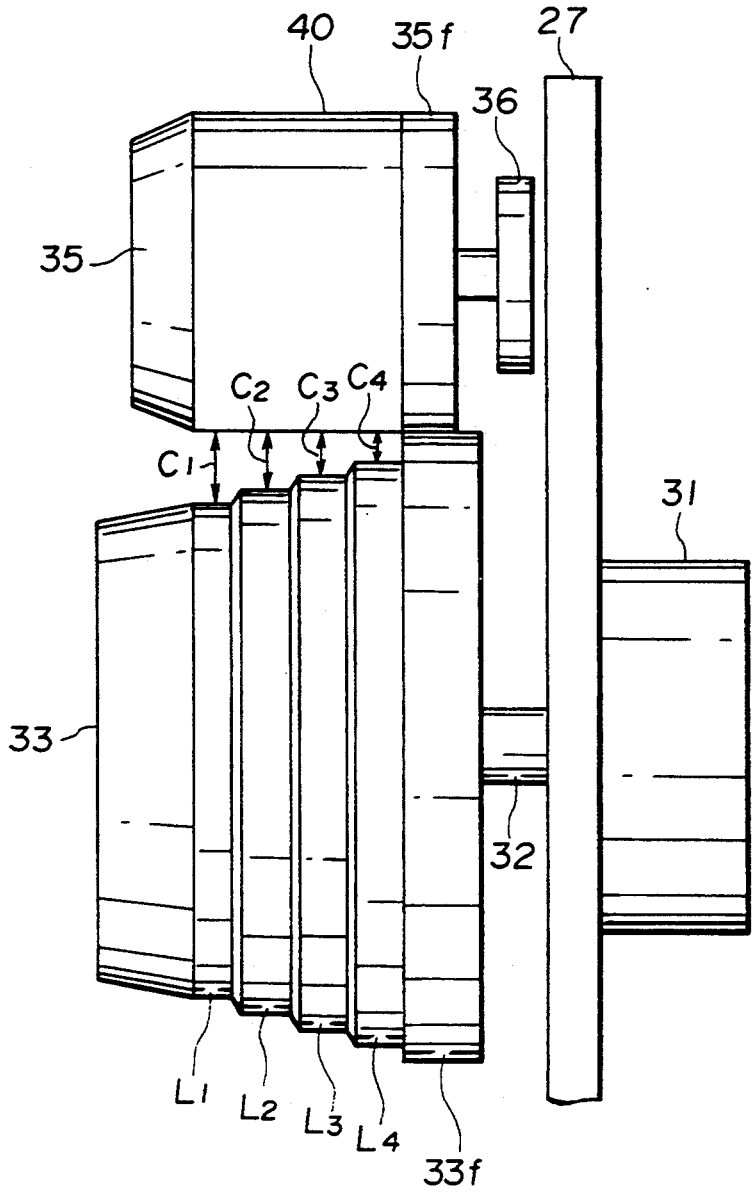
FIG. 15 is a fragmentary side view of the weft traction device forming part of a fourth embodiment of the weft picking system in accordance with the present invention.

FIG. 15 illustrates a part of a fourth embodiment of the weft picking system of the present invention, which is similar to the first embodiment. The weft traction device 30 is similar to that of the second embodiment of FIG. 12 with the exception that the roller 33 is formed at its peripheral surface with a plurality of cylindrical sections L1 to L4 which are coaxially arranged and contiguous with each other. The cylindrical sections L1 to L4 are successively reduced in diameter in the order of a direction of movement of the weft yarn Y when the weft yarn Y is put into the engaged condition (to the rollers) from the disengaged condition. Accordingly, a plurality of annular clearances C1 to C4 are formed between the rollers 33 and 35, in which a dimensional relationship among the clearances C1 to C4 is C1>C2>C3>C4.

In this connection, the traverse lever 52 of the change-over device 50 is arranged to take a plurality of positions at which the weft yarn Y is put between the rollers 33, 35, so that the weft yarn Y can be inserted into one of the clearance C1 to C4. This enables weft yarns having different thicknesses to be used without replacement of rollers (33, 35) and adjustment of the clearance C between the rollers 33, 35.

A fifth embodiment of the weft picking system of the present invention is provided with the controller 120 which is arranged such that the change-over operations of the change-over device 50 are controlled in accordance with the signal representative of designation of one of the weft yarns Y, the signal being generated by and output from the weft selection command device 122. The change-over operations are movements of the traverse levers 52, each movement causing the weft yarn to be put into the engaged condition (to be engaged with the rollers 33, 35) from the disengaged condition (to be disengaged from the rollers 33, 35) or vice versa.

With this arrangement, since selection of the weft yarn Y and operation of the engaging pin 14 are made in the same weaving cycle, the change-over operations of the change-over device 50 are sufficiently high in response thereby enabling the loom to operate at a high speed. Additionally, the engaging pin 14 and the change-over device 50 are operated for the same weft yarn Y in response to the same signal from the weft selection command device 122, and therefore there is no possibility of occurrence of simultaneous failed weft pickings in both weft picking systems E1, E2. This prevents the availability of the loom from being reduced owing to stopping of the loom.

Figure 16:
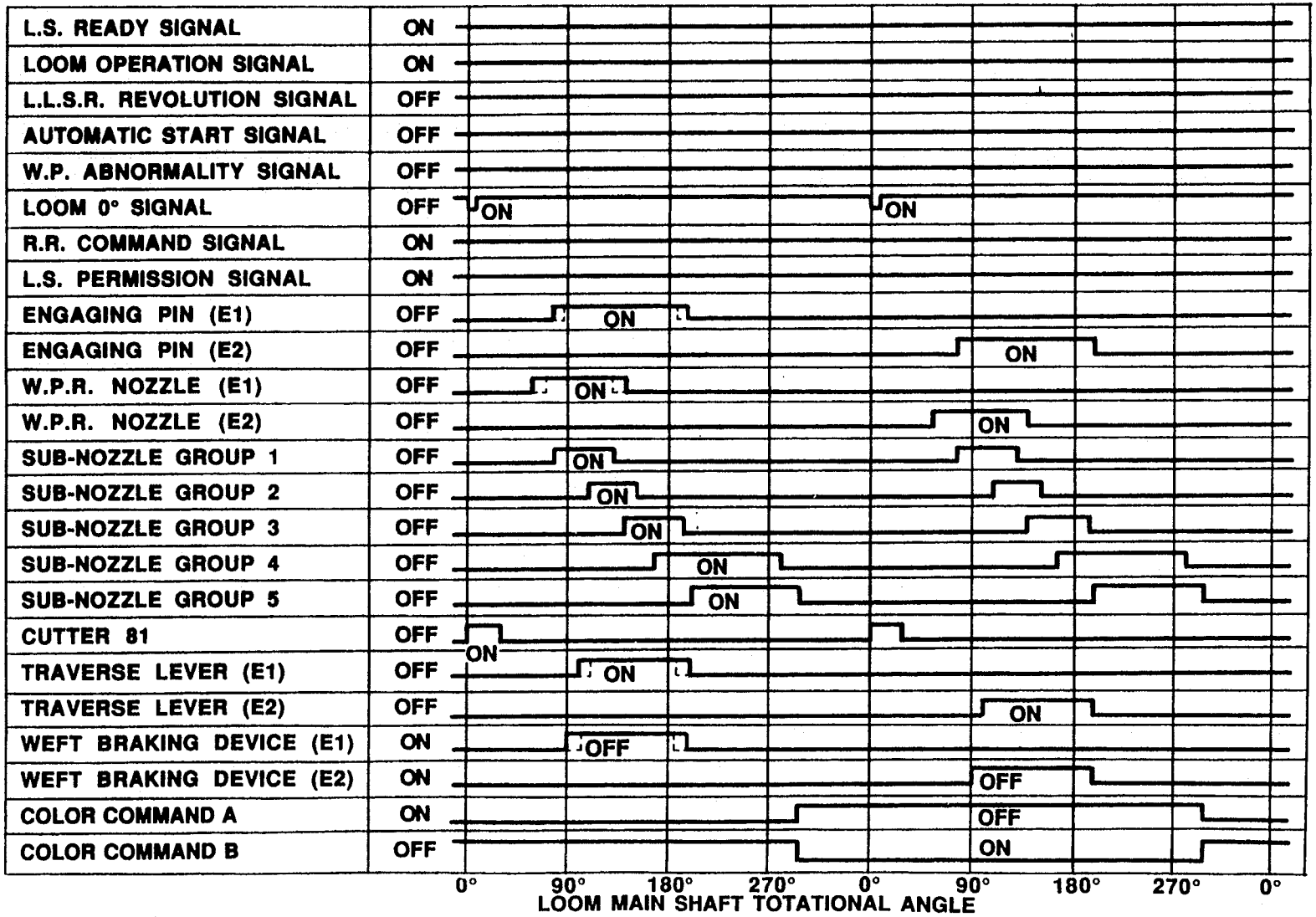
FIG. 16 is a time chart similar to FIG. 8 but showing the control operation of a sixth embodiment of the weft picking system in accordance with the present invention.

FIG. 16 illustrates a control operation by the controller 120 of a sixth embodiment of the weft picking system of the present invention. In this control operation, the operational timings of at least the change-over device 50 during a loom starting period is different from those during a loom normal operating period. The loom starting period is initiated from a timing at which the start button 121*b* is pushed to start the rotation of the loom main motor 7. The loom normal operating period is initiated from a timing at which the loom starting period is terminated.

More specifically, during the loom starting period in which the rotational speed of the loom main motor 7 gradually increases, the controller 120 makes an operational command to the change-over device 50 so that the operational timings are different from those during the loom normal operating period in response to lowering in warp shedding speed, as shown in a time chart of FIG. 16. In the time chart, solid lines indicate the operational timings of the traverse lever 52 of the change-over device 50 in the weft picking system E1 during the loom staring period, whereas broken lines indicate those during the loom normal operating period. As a result, the weft yarn traction by the weft traction device 30 can be made during a period in which the warp shed is sufficiently opened even in the loom starting period thereby preventing mispick.

A seventh embodiment of the weft picking system of the present invention is provided with the controller 120 which makes a control such that the start of loom is obstructed (i.e., the loom main motor 7 cannot be switched ON) until the rotational speed of the roller 33 has reached a predetermined high level to make a normal operation of the weft traction device 30 or until a predetermined time for which the predermined high level of the roller rotational speed is reached has lapsed. Accordingly, the rotational speed of the roller 33 has reached the predetermined level, thereby obstructing a loom starting before the roller rotational speed has not yet reached the predetermined level and thus avoiding occurrence of mispick.

Figure 17:
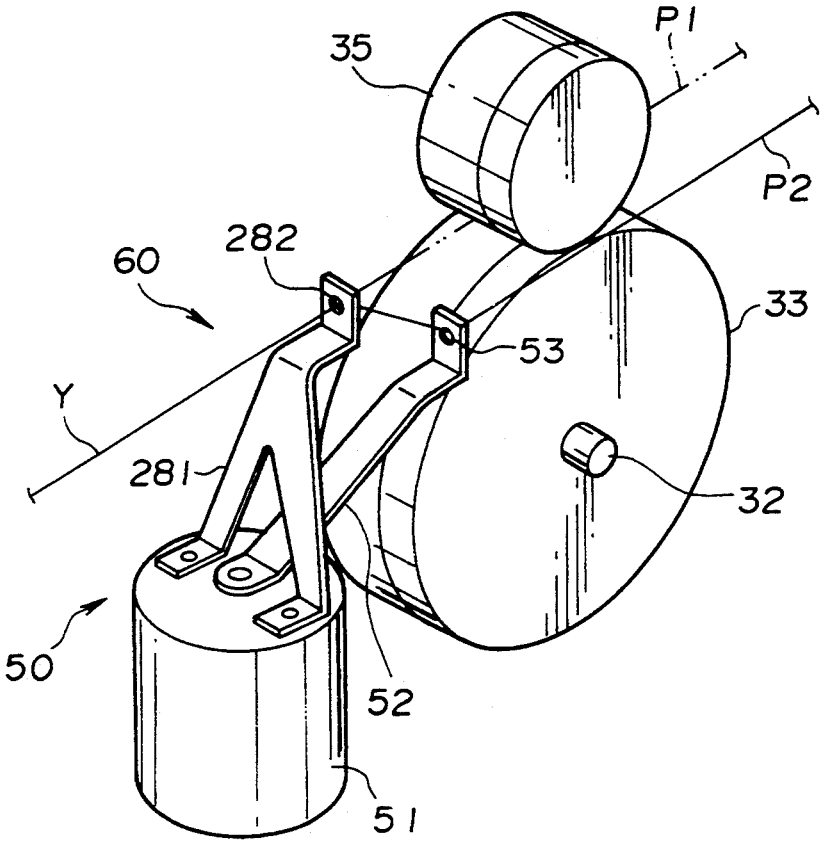
FIG. 17 is a perspective view of a weft braking device of an eighth embodiment of the weft picking system according to the present invention.
Figure 18:
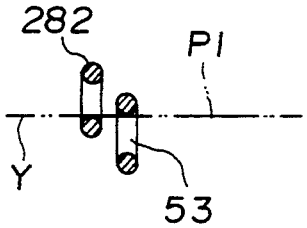
FIGS. 18 and 19 are respectively cross-sectional views showing an operation of the weft braking device of FIG. 17.
Figure 19:
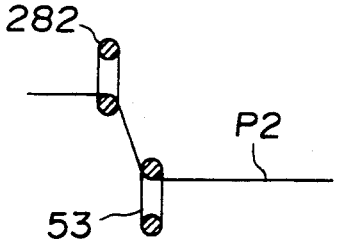

FIGS. 17 to 19 illustrate a part of an eighth embodiment of the weft picking system according to the present invention which is similar to the first embodiment. In this embodiment, the weft braking device 60 is incorporated with the change-over device 50. More specifically, the weft braking device 60 includes a yarn guide 281 formed of a metal plate and formed at its tip end with a weft passing hole 282 through which the weft yarn Y passes. The yarn guide 281 is fixedly mounted on a cover (no numeral) of the rotary solenoid 51. When the weft yarn Y is on the normal weft path P1, it passes through the weft passing hole 282 to freely run as shown in FIG. 18. However, when the weft yarn Y is put on the displaced weft path P2 upon the traverse lever 52 being moved in a position shown in FIG. 17, the running movement of the weft yarn Y is restricted by the weft passing hole 282 and the yarn insertion hole 53 which are separate from each other as shown in FIG. 19. Thus a running resistance is applied to the running weft yarn Y. With this arrangement, since weft braking device 60 is operated in response to the change-over action of the change-over device 50, the operation of the weft braking device 60 is made at a precise timing and therefore this arrangement is suitable for a high speed loom operation.

Figure 20:
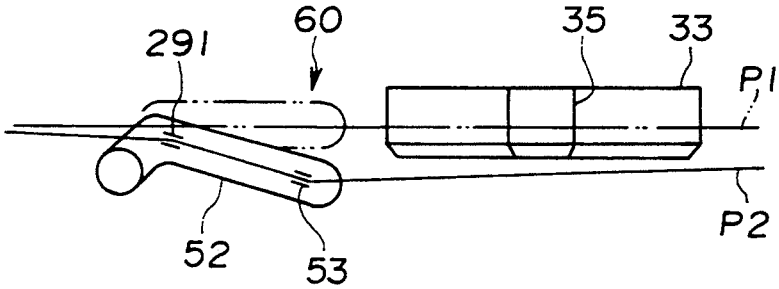
FIG. 20 is a planar illustration of a modified example of the weft braking device of FIG. 17.

FIG. 20 shows a modified example of the weft braking device 60 similar to that in FIG. 17 with the exception being that the separate yarn guide 281 is omitted. In this example, a yarn guide 291 is provided on the traverse lever 52 and located upstream of the yarn insertion hole 53 with respect to the running direction of the weft yarn Y. With this arrangement, when the weft yarn Y is on the normal weft path P1 and between the rollers 33, 35, the weft yarn Y can freely run through the yarn guide 281 and the yarn insertion hole 53. However, when the weft yarn Y is put on the displaced weft path P2 under the displacement of the traverse lever 52, a restriction is applied to the running weft yarn Y under the action of the yarn guide 291 and the weft insertion hole 53, thus applying a running resistance to the weft yarn Y.

Figure 21:
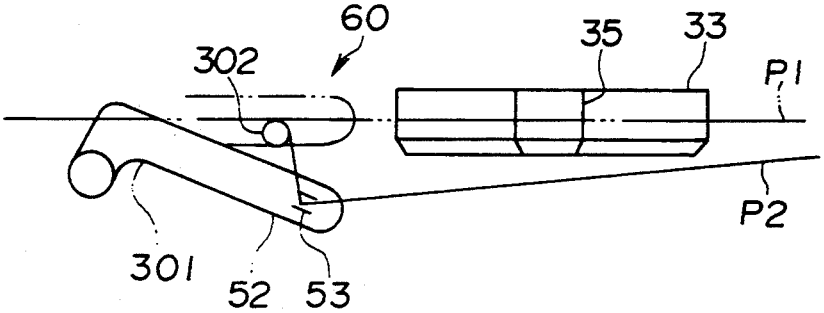
FIG. 21 is a planar illustration of another modified example of the weft braking device of FIG. 17.

FIG. 21 shows another modified example of the weft braking device 60 similar to that of FIG. 17 with the exception that the yarn guide 281 is replaced with a rod member 302 which is fixedly disposed above the traverse lever 52. The rod member 302 is located generally on the normal weft path P1 and slightly one-sided to the displaced weft path P2. When the weft yarn Y is released from the rollers 33, 35 and put on the displaced weft path P2, the weft yarn Y is bent at and brought into press contact with the rod member 302 so as to receive a running resistance.

Figure 22:
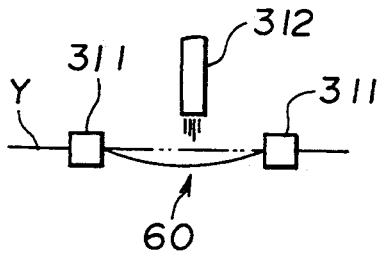
FIG. 22 is a planar illustration of a further modified example of the weft braking device of FIG. 17.

FIG. 22 shows a further modified example of the weft braking device 60, in which the weft braking device 60 includes a pair of yarn guides 311 disposed on the normal weft path Pl. A brake nozzle 312 is disposed near the normal weft path P1 and between the yarn guides 311 to eject air jet to the weft yarn Y between the yarn guides 311. When the brake nozzle 312 makes its air ejection, the weft yarn Y is pushed against the yarn guides 311 and therefore receives a running resistance under the influence of flowing air from the brake nozzle 312.

Next, a ninth embodiment of the weft picking system of the present invention will be discussed. This embodiment is similar to the first embodiment and includes the controller 120 which makes a control such that the operations of the engaging pin 14 and the weft traction device 30 are in timed relation to each other thereby allowing the computing of the operation timing of one of the engaging pin 14 and the weft traction device 30 in accordance with the other of them, in order to simplify the construction of the weft measuring and storing device 10.

The principle of this embodiment will be explained in detail with reference to FIG. 23. As will be understood, in a conventional weft picking system in which weft picking is carried out only under the influence of fluid (such as air), traction of a weft yarn is accomplished by a friction between the weft yarn and the fluid, and therefore a traction force relative to a predetermined amount of the fluid changes in accordance with a moisture absorbing condition and a fluff condition of the weft yarn, a humidity in atmospheric air, an ambient temperature and the like. Accordingly, a carried speed of the weft yarn by a fluid stream changes in respective weft pickings. In this regard, in a weft measuring and storing device in the conventional weft picking system, it is necessary to control the operations of an engaging pin in accordance with the number of unwound turns of the weft yarn wound on a drum, the unwound turn number being detected by a weft unwinding sensor. This requires a control device which is expensive and makes for a high level and precision control.

However, in the weft picking system of the present invention using the roller type weft traction device 30, the drawn speed of the weft yarn by the roller type weft traction device 30 is univocally determined in accordance with the peripheral speed of the roller 33, and therefore the carried or drawn speed of the weft yarn becomes generally constant. As a result, it becomes possible that the operation of the weft measuring and storing device 10 is controlled in accordance with the loom main shaft rotational angle without using the weft unwinding sensor.

With the roller type weft traction device 30 of the present invention, the weft yarn Y is directly drawn by the roller, and therefore there is the possibility of the weft yarn being broken when the weft yarn Y is in engagement with the engaging pin 14. Accordingly, the timing of traction of the weft yarn Y by the roller 33 is set to accomplish the weft yarn traction during a time in which the engaging pin 14 is withdrawn or separate from the drum 11. Here, such a direct traction of the weft yarn Y by the roller 33 is small in energy loss as compared with the above-mentioned conventional traction (under the action of friction between the weft yarn and the fluid) by the fluid, and therefore is high in energy saving effect. In this regard, it is preferable to prolong the time during which the weft traction by the roller is made.

Taking into consideration the above, the weft traction by the roller 33 is initiated later by $\alpha$ degree (in loom main shaft rotational angle).. than the withdrawal (turned to the OFF state) of the engaging pin 14 from the drum 11, and the weft traction by the roller 33 is terminated earlier by $\beta$ degree, than the timing at which the weft yarn is brought into engagement with the engaging pin 14 upon the engaging pin 14 being projected to the drum 11. The above-mentioned $\alpha$ and $\beta$ are predetermined.

Subsequently, the setting the operational timings of the engaging pin 14 and the roller traction device 30 (or the traverse lever 52 of the change-over device 50) will be explained. In the event of looming to change kind of yarns, the operational timings of the engaging pin 14 is set to be suitable for the yarns, which is accomplished in accordance with a weft unwinding timing (at which the weft yarn Y is unwound from the drum 11) and a weft reaching timing (at which the weft yarn Y reaches the counter-weft picking side) upon inserting the weft yarn Y into the warp shed during a gaiting before start of a loom weaving operation. The weft unwinding timing is detected by a weft unwinding sensor (not shown). The weft reaching timing is detected by the weft reaching sensor 100. The weft unwinding timing and the weft reaching timing are plotted to obtain a graph (FIG. 23) of a weft yarn carried or flying characteristic in which location of the tip end section of the picked weft yarn is shown in terms of the loom main shaft rotational angle.

Figure 23:
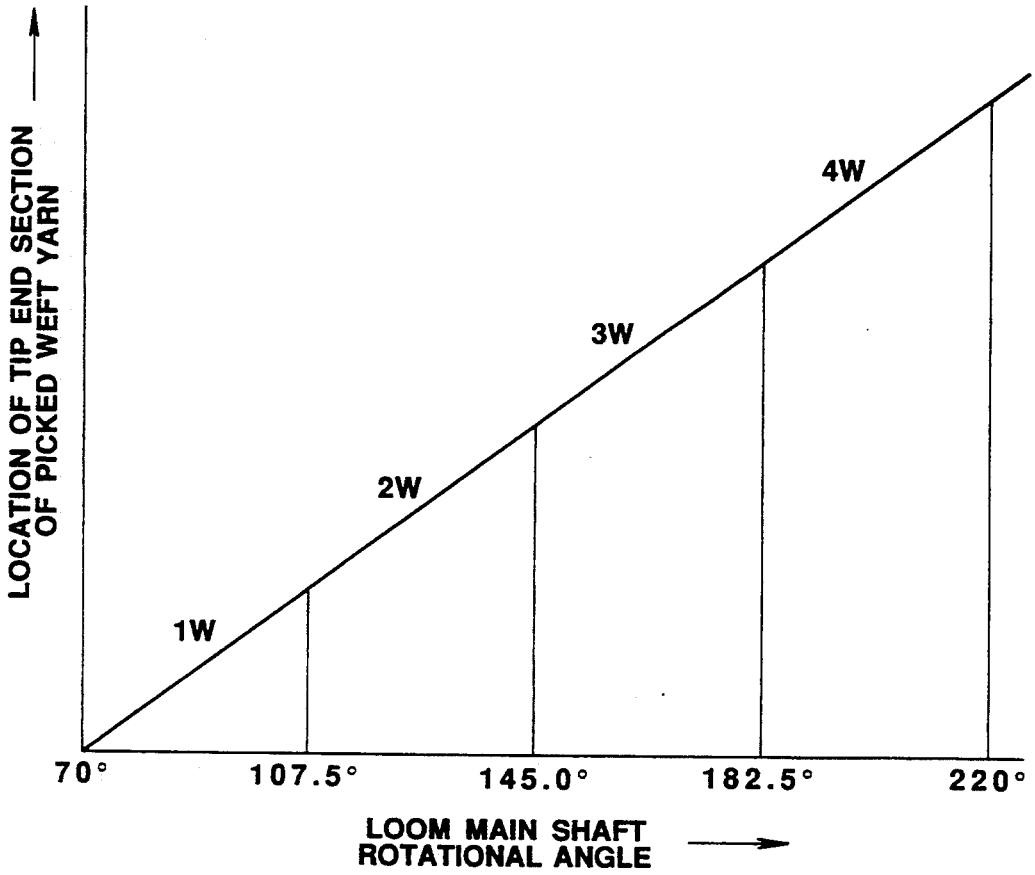
FIG. 23 is a graph illustrating the operation of a ninth embodiment of the weft picking system in accordance with the present invention.

With reference to the graph of FIG. 23, in case of a setting at 70 degrees (in loom main shaft rotational angle) the timing at which the engaging pin 14 is withdrawn or gets out from the drum, it is assumed that the weft reaching sensor 100 detects the weft yarn at 220 degrees so that the tip end section of the weft yarn has reached the counter-weft picking side. "1W", "2W", ""3W and "4W" in the graph respectively denote unwindings of the first, second, third and fourth turns of the weft yarn wound on the drum. The "location of tip end section of picked weft yarn" represents a location of the tip end section of the picked weft yarn Y from the engaging pin 14 of the weft measuring and storing means 10. Thus, the unwinding of the fourth turn of the wound weft yarn is made at 182.5 degrees, and the weft reaching to the counter-weft picking side is made at 220 degrees (which is regarded as a timing at which the weft yarn Y is brought into engagement with the engaging pin 14). Accordingly, the timing is so set that the engaging pin 14 is projected to the drum 11 (or turned to ON state) at the mid-point (201 degrees) between 182.5 and 220 degrees. Additionally, the above-mentioned $\alpha$ is set within a range of 0 to 50 degrees, while the $\beta$ is set within a range of 0 to 40 degrees in accordance with the kind of yarn. The $\alpha$ and $\beta$ are experimentally determined. Since pressurized air consumption is reduced particularly as the traction time of the roller 33 is prolonged, it is preferable that $\alpha$ and $\beta$ are small. However, if $\alpha$ and $\beta$ are excessively small, there is the possibility of occurrence of weft yarn breaking due to the fact that the traction of the roller is made during a time within which the engaging pin 14 is being projected to the drum 11, particularly in case of using solenoids which make large operational errors of the engaging pin 14 and the traverse lever 52 of the change-over device 50. If $\alpha$ is excessively small, there is the possibility of the weft yarn being drawn by the roller 33, which is always rotating at a high speed, before the weft yarn makes its slow speed running under the influence of air jet ejection by the weft posture regulating nozzle 71, in the case of using a thick yarn which is low in carried speed relative to a predetermined amount of pressurized air. This increases the difference between a weft feeding speed due to the traction of the roller 33 and another weft feeding speed due to the weft posture regulating nozzle 71, which will cause slackening of the running weft yarn in the weft picking. The weft yarn slackening will cause mispick and/or weave defect in a woven fabric. Hence, $\alpha$ cannot be excessively minimized relative to the kind of yarn used. For example, in case that the withdrawal timing of the engaging pin 14 is 70 degrees while the weft reaching timing is 220 degrees as shown in FIG. 22, input to the controller 120 is made such that the releasing of the weft yarn Y from the engaging pin 14 is set at a range of 70 to 201 degrees (the engaging timing of the weft yarn with the engaging pin being 220 degrees), and $\alpha=20$ degrees and $\beta=20$ degrees. Under such input, a computing unit (not shown) in the controller 120 makes adding and subtracting calculations, thereby setting within a range of 90 to 200 degrees a time for making the weft yarn traction by the roller 33.

FIGS. 24A to 28C illustrate a tenth embodiment of the weft picking system E of the present invention, which is similar to the first embodiment except for the provision of a weft threading system T incorporated with the weft picking system E. The weft threading system T functions to automatically accomplish a weft threading operation between the weft supply member 1 and the weft posture regulating nozzle 71, in the loom provided with the weft picking system.

The operation of the weft threading system T will be discussed with reference to FIGS. 24A to 28C. Prior to the weft threading operation, a new weft supply member (bobbin) 1 is set in a manner that the tip end section of the weft yarn Y is previously inserted in a hollow core (indicated by broken lines). An air ejection nozzle 401 is disposed at the rear side of the hollow core of the new weft supply member 1. When the yarn of a weft supply member 1' has been used up, the loom is stopped, and then the yarn of the new weft supply member 1 will be threaded to the weft posture regulating nozzle 71 as discussed hereinafter.

Figure 24A:
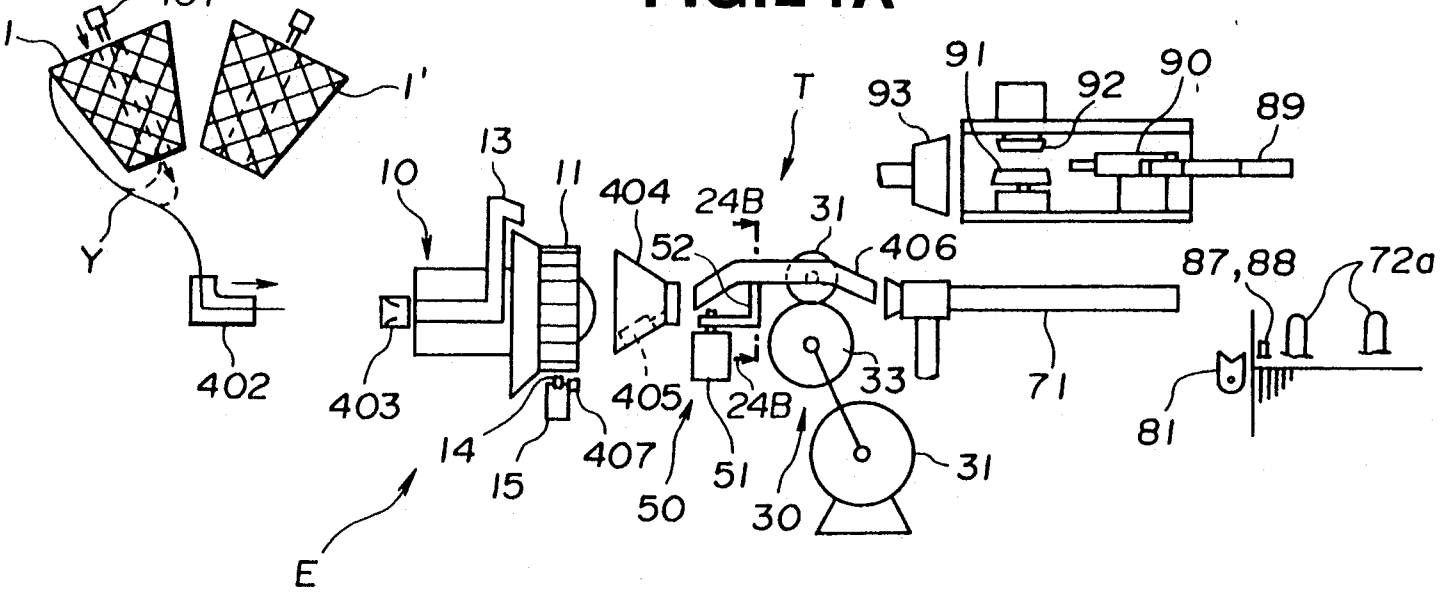
FIGS. 24A to 24C are schematic illustrations of a first state of operation of a tenth embodiment of the weft picking system in accordance with the present invention.
Figure 24C:
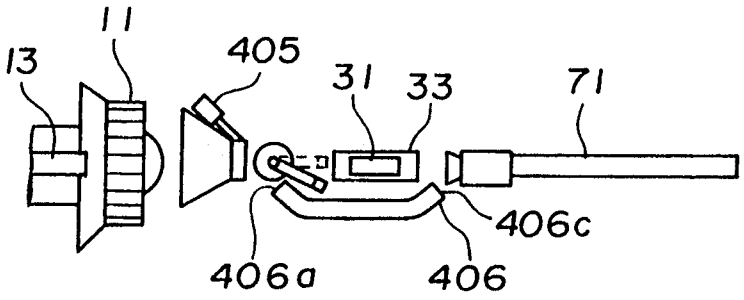
Figure 24B:
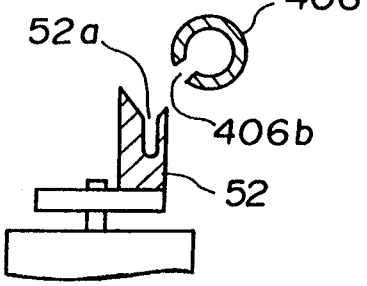

First, referring to FIGS. 24A to 24C, air is ejected from the air ejection nozzle 401 to cause the tip end section of the weft yarn Y in the hollow core of the weft supply member 1 to fly toward a booster 402. Simultaneously, the booster 402 initiates ejection of air thereby sucking the weft yarn tip end section and causing it to fly toward a booster 403 located at the inlet of the weft winding arm 13 of the weft measuring and storing device 10. The weft winding arm 13 is formed with an elongate hollow extending along its axis. An air stream passes through the hollow.

Figure 25A:
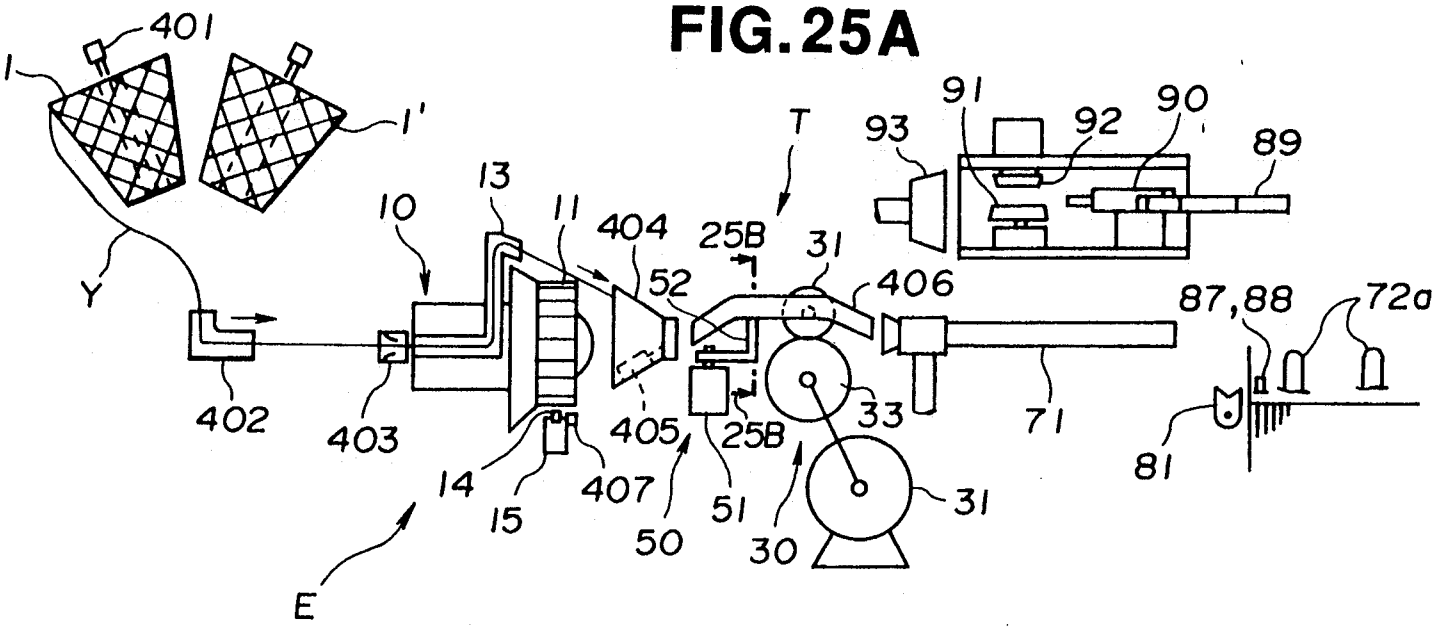
FIGS. 25A to 25C are schematic illustrations of a second state of operation of the tenth embodiment weft picking system.
Figure 25C:
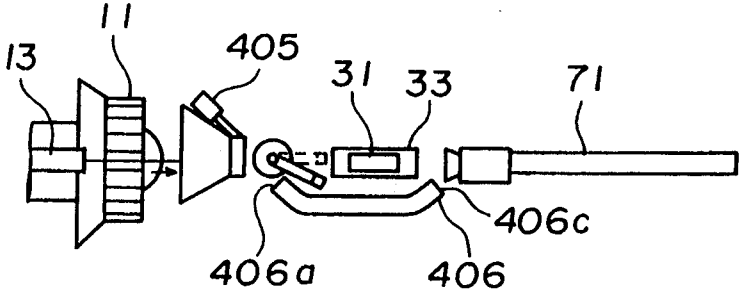
Figure 25B:
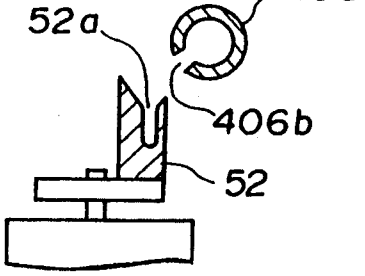

Then, as shown in FIGS. 25A to 25C, the booster 403 makes its air ejection to suck the weft yarn tip end section and thread it into the hollow of the weft winding arm 13 through the inlet of the hollow weft winding arm 13. The weft yarn tip end section passed through the hollow of the weft winding arm 13 flies from the inlet of the weft winding arm 13 toward a generally frustoconical yarn guide 404. At this time, air ejection from the air ejection nozzle 401 and from the booster 402 is stopped.

Figure 26A:
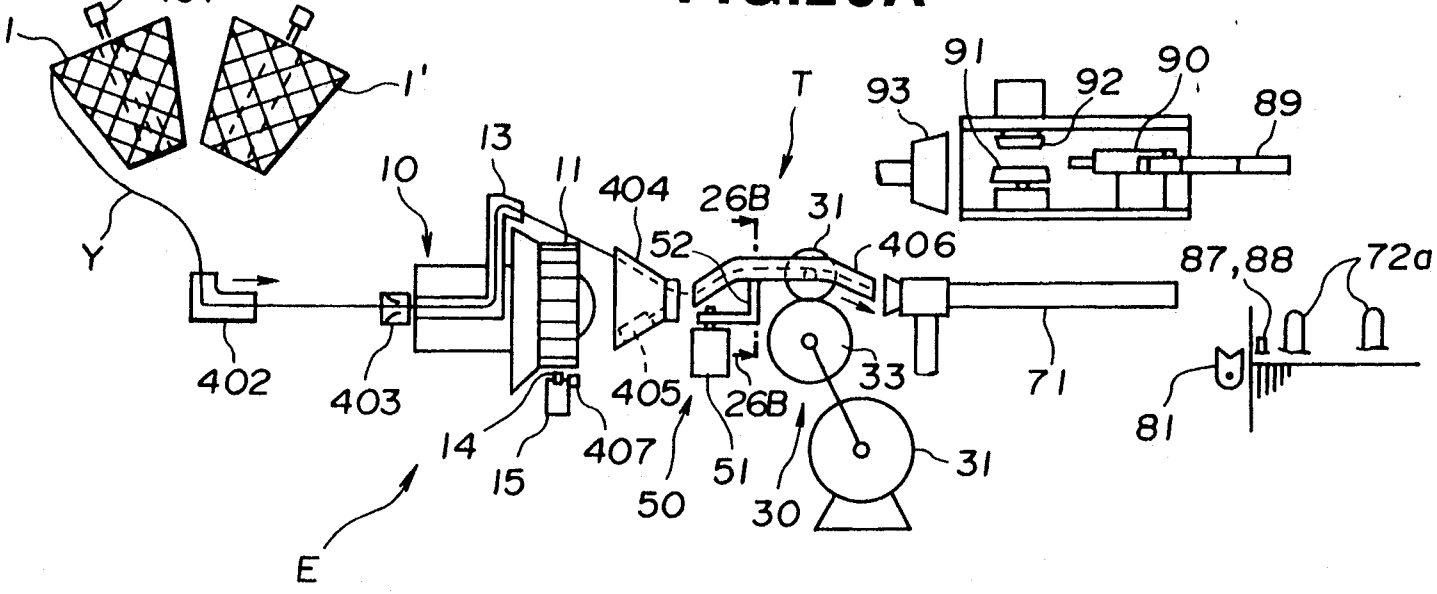
FIGS. 26A to 26C are schematic illustrations of a third state of operation of the tenth embodiment weft picking system.
Figure 26C:
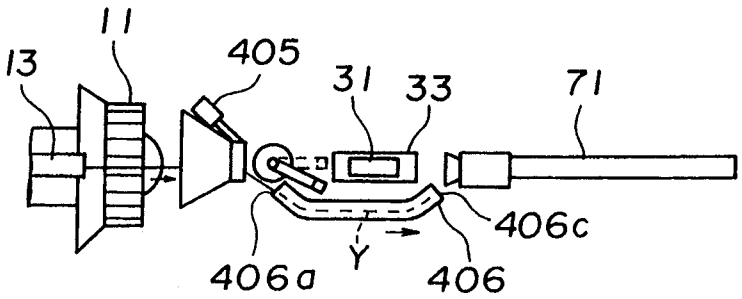
Figure 26B:
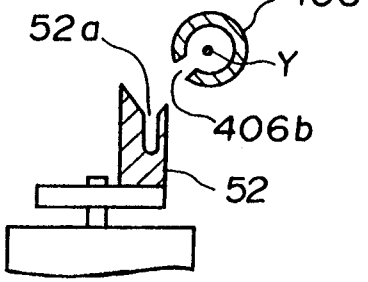

Subsequently, as shown in FIGS. 26A to 26C, air is ejected from an air ejection nozzle 405 disposed on the yarn guide 404 toward one end opening 406*a* of a curved pipe 406 having a slit 406*b*. The slit 406*b* extends axially to connect the one end opening 406*a* and the other end opening 406*c*. Upon air ejection of the air ejection nozzle 405, the weft yarn Y is threaded into the curved pipe 406. At this time, the weft posture regulating nozzle 71 starts to eject air, so that the weft yarn Y is threaded in the weft posture regulating nozzle 71. Additionally, air ejection from the booster 403 is stopped.

Figure 27A:
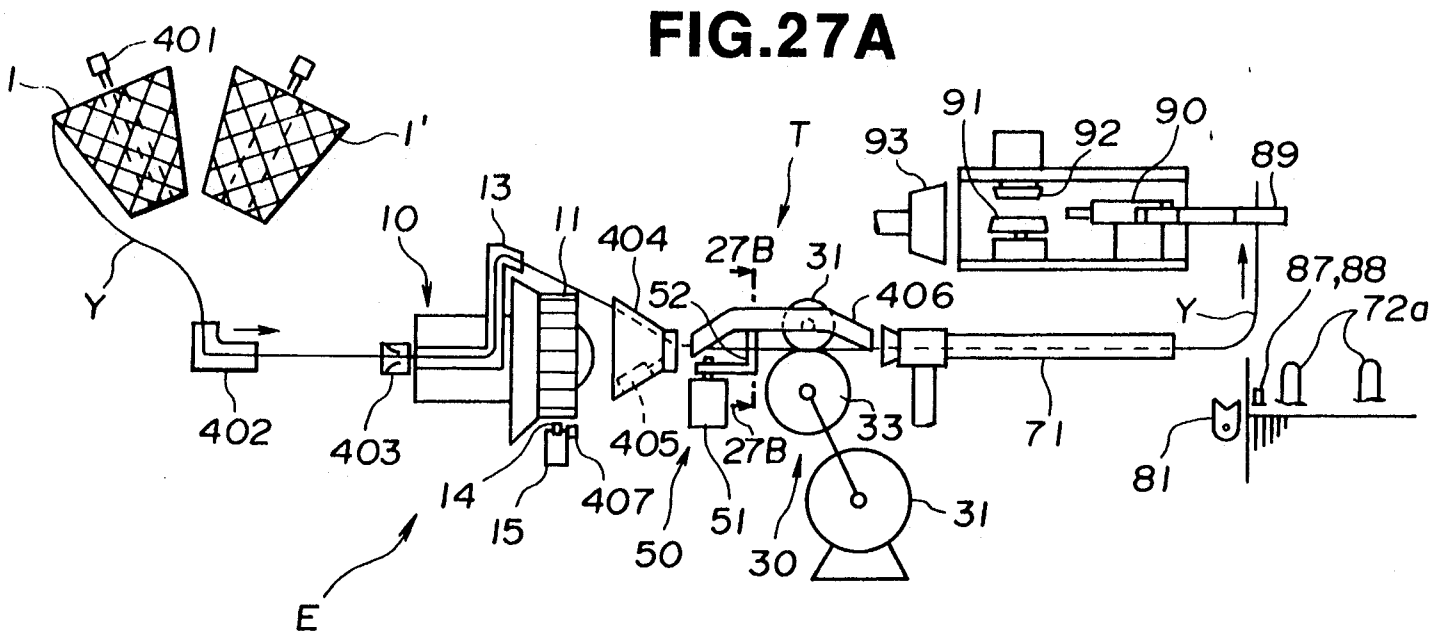
FIGS. 27A to 27C are schematic illustrations of a fourth state of operation of the tenth embodiment weft picking system.
Figure 27C:
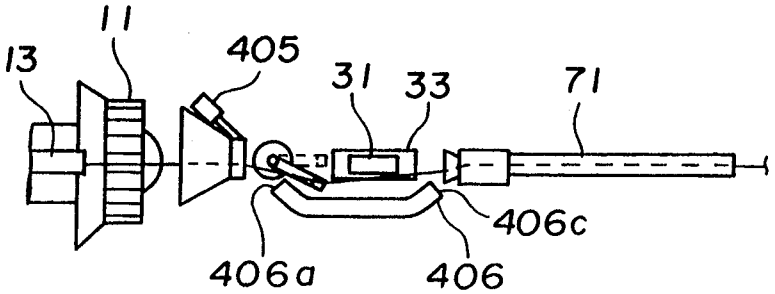
Figure 27B:
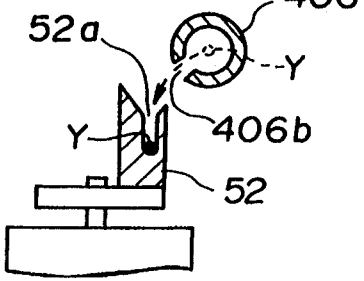

Thereafter, as shown in Figs. FIGS. 27A to 27C, air ejection from the air ejection nozzle 405 is stopped, and therefore the weft yarn Y gets out of the curved pipe 406 through the slit 406*b* under the pulling force due to the air ejection from the weft posture regulating nozzle 71 and is then transferred to the traverse lever 52. In this embodiment, the traverse lever 52 is formed at its tip end section with a vertically extending groove 52*a* for receiving the weft yarn Y. The weft yarn Y threaded in the weft posture regulating nozzle 71 extends to the downstream side of the weft posture regulating nozzle 71. Then, air ejection from the blow-up nozzles 87, 88 is made, so that the tip end section of the weft yarn Y is blown up vertically. At this time, air ejection from the weft posture regulating nozzle 71 is stopped. Then, air ejection from the air mover 90 is started, and the transferring arm 89 is swingingly moved to transfer the tip end section of the weft yarn Y to the air mover 90.

Figures 28A, 28B, 28C:
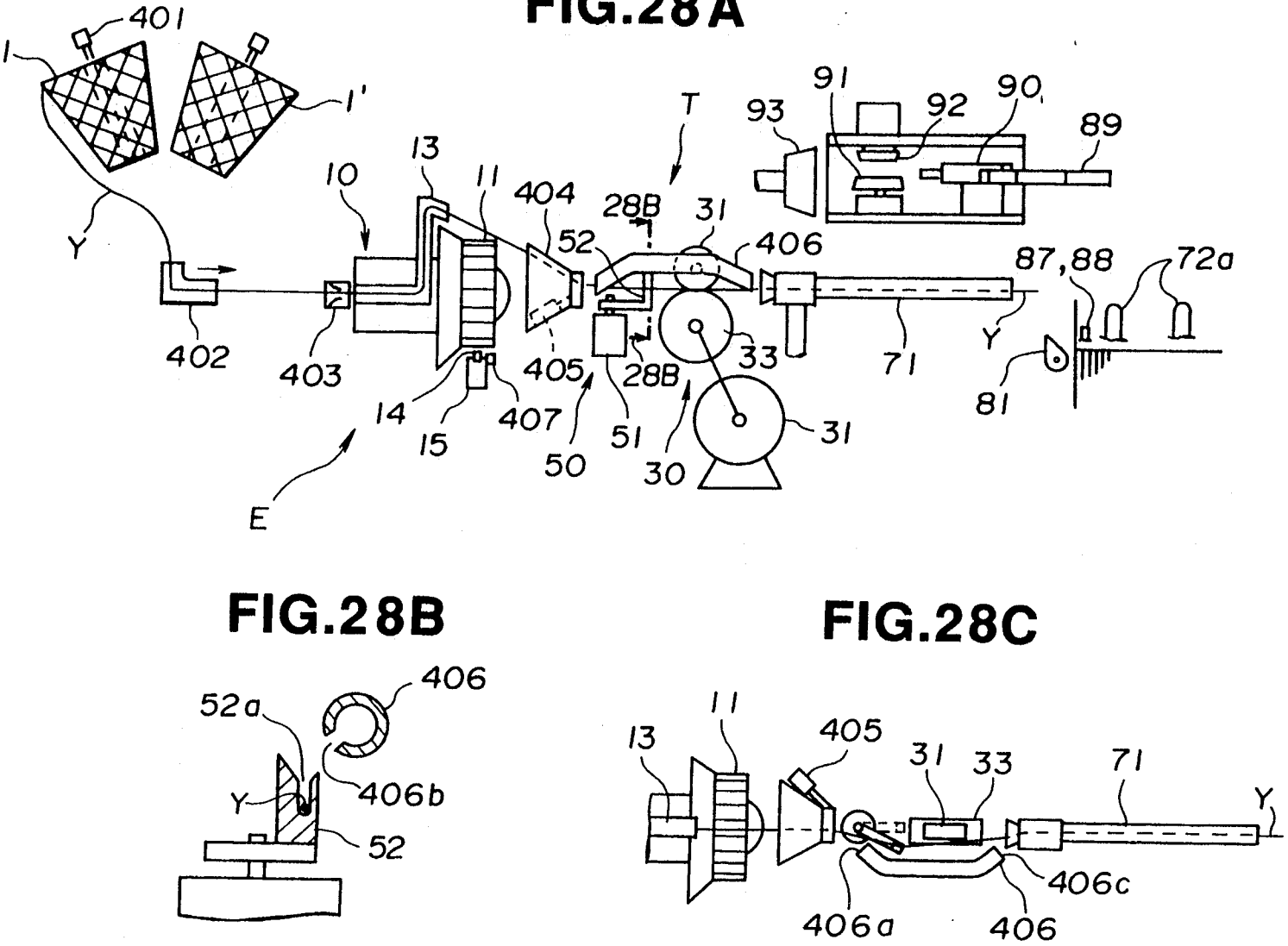
FIGS. 28A to 28C are schematic illustrations of a fifth state of operation of the tenth embodiment weft picking system.

Finally, as shown in FIGS. 28A to 28C, when the weft yarn tip end section is transferred to the air mover 90, the reed (3) is advanced so that the weft yarn Y is brought to the position of the cutter 81 and then cut. Furthermore, air ejection from the air mover 90 is continued and therefore the weft yarn tip end section extending from the air mover 90 is grasped by the take-up rollers 91, 92 which are brought into contact with each other under the action of the air cylinder. Additionally, the rollers 91, 92 are rotated by the motor so that the weft yarn tip end section is wound on the take-up rollers 91, 92. Thereafter, the take-up rollers 91, 92 are separated from each other, so that the tip end section of the weft yarn Y is sucked by the suction device 93 to be discarded. The reference numeral 407 designates the weft unwinding sensor for detecting unwinding of each turn of the weft yarn Y wound on the drum 11 of the weft measuring and storing device 10.

Figure 29:
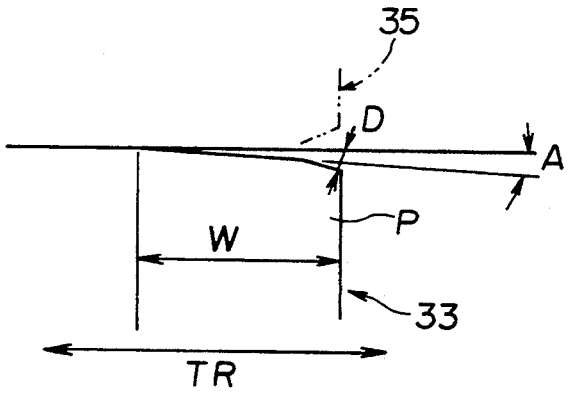
FIG. 29 is a fragmentary side view of a roller of the weft traction device of an eleventh embodiment of the weft picking system in accordance with the present invention.

FIG. 29 illustrates a part of an eleventh embodiment of the weft picking system of the present invention, which is similar to the first embodiment. In this embodiment, the press-contact or frictional force of the roller 33 against the weft yarn Y is changed to improve an effect of preventing a weft yarn slackening due to the difference in traction force to the weft yarn between the roller 33 and the weft posture regulating nozzle 71 at an initial period of the traction action of the weft traction device 30. Such a change in press-contact force is accomplished, for example, by arranging the peripheral portion P of an end section of the roller 33 of the weft traction device 30 which is formed generally frustoconical so that the outer diameter of the roller 33 gradually decreases toward the extreme end of the end section peripheral portion P through which the weft yarn Y is inserted into between the rollers 33, 35 when the weft yarn Y is put onto its normal path (P1) from its displaced path (P2), as shown in FIG. 29. In this embodiment, when a denim yarn having a diameter of 0.3 to 0.5 mm is used as the weft yarn Y, it is preferable that the axial width W of the end section peripheral portion P is 8 mm; and the inclination angle A of the outer peripheral surface of the peripheral portion P relative to the cylindrical peripheral surface of the roller 33 is 5 degrees. It is also preferable that a distance D of the tip end of the peripheral portion P relative to the extension of the cylindrical peripheral surface of the roller 33 is 0.7 mm. In this embodiment, a traverse amount TR of the traverse lever 52 is 12 mm, the amount TR being a distance of movement of the weft yarn Y from its normal weft path P1 to its displaced weft path P2 or vice versa.

Figure 30:
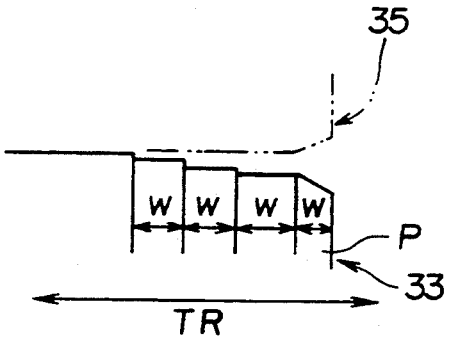
FIG. 30 is a fragmentary side view similar to FIG. 29 but showing a modified example of the roller of the weft picking system of FIG. 29.

FIG. 30 shows a modified example of the end section peripheral portion P of the roller 33, which is similar to that in FIG. 29 with the exception that the generally frustoconical end section peripheral portion P is formed of three cylindrical peripheral surfaces whose respective diameters reduce toward the extreme end of the peripheral portion P. When weft yarn such as that used in FIG. 29 is used, it is preferable that the respective cylindrical peripheral surfaces reduce 0.2 mm toward the extreme end of the peripheral portion P relative to the adjacent cylindrical peripheral surface; and the axial width w of each cylindrical peripheral surface is 2 mm.

Next, a twelfth embodiment of the weft picking system of the present invention will be discussed. This embodiment weft picking system is similar to the first embodiment and includes the controller 120 which is arranged to make a control such that an operational condition of the weft traction device 30 is computed and set in accordance with a weaving condition (including a weaving width, a loom main shaft rotational speed, kind of yarn and the like) input to the controller 120, in order to facilitate setting of the operational condition of the weft traction device 30.

Explanation of the control of this embodiment will be made with respect to a specific example. In this example, the weaving condition is set such that the weaving width (corresponding to the width of a woven fabric) is 1.7 m; the loom main shaft rotational speed is 700 r.p.m.;

and the yarn kind is a denim yarn having a diameter of 0.3 to 0.5 mm. A loom operational condition is set as follows: A flight time of the weft yarn Y is from 80 to 234 degrees in loom main shaft rotational angle, in which the weft yarn Y initiates its flight at the timing or angle of 80 degrees upon withdrawal of the engaging pin 14 and terminates its flight at the timing or angle of 234 degrees upon reaching the counter-weft picking side so that the tip end section of the weft yarn Y makes its flight throughout a distance corresponding to the above-mentioned weaving width. Such timings are determined to accomplish a secure flight of the weft yarn Y within a time period in which the warp shed is opened, and therefore different depending upon the kind of used yarn and the like. A traction time (for which the weft yarn is drawn) of the weft traction device 30 is better to be long from the view point of energy saving; however, the traction of the weft yarn by the weft traction device 30 is made preferably after the weft yarn Y is released from restraint of the engaging pin 14, and preferably after the running speed of the weft yarn Y reaches a predetermined speed upon traction of the weft posture regulating nozzle 71 for the purpose of preventing disadvantages such that a weft feed speed of the weft traction device 30 becomes larger than that of the weft posture regulating nozzle 71 at the initial period of the traction of the weft traction device 30 which would cause the weft yarn to be caught by the weft posture regulating nozzle 71 raising mispick. If the weft yarn is caught by the weft posture regulating nozzle 71 slackening of the weft yarn Y may form, upon which a slackened portion of the weft yarn Y will be woven in the woven cloth thereby forming a weave defect. In view of the above, the traction time of the weft traction device 30 is from a timing of 90 degrees to a timing of 190 degrees in loom main shaft rotational angle. In this example, the diameter of the roller 33 of the weft traction device 30 is 190 mm.

The above-mentioned weaving condition and the loom operational condition are input to the controller 120, upon which the controller 120 makes the following computation:

$$V(\text{m/min.}) = R(\text{r.p.m.}) \times L(\text{m}) \times 360(\text{degrees})/\text{flight angle (degrees)}$$

where V is an average weft picking speed (or weft yarn flight speed); R is a rotational speed of the loom main shaft; and L is the weaving width. The flight angle represents a width in loom main shaft rotational angle at which width the picked weft yarn is flying.

If the above-mentioned condition is substituted into the above equation for the average weft picking speed, $$V(\text{m/min.}) = 700 \times 1.7 \times 360/154 = 2782(\text{m/min.}).$$

Accordingly, a rotational speed W1 of the roller 33 of the weft traction device 30 is given by the following equation:

$$W1 = V/I = 4636(\text{r.p.m})$$

where I is a peripheral length of the roller 33.

However, when the weft yarn Y is drawn by the weft posture regulating nozzle 71 at the initial stage of the weft picking, the weft yarn speed gradually increases from 0. Accordingly, a slight slip of the weft yarn Y is made when the weft yarn Y is drawn by the roller 33 of the weft traction device 30. In this regard, the roller rotational speed W1 or roller traction speed is corrected or increased by an amount corresponding to the slip to obtain a corrected roller rotational speed W2. Here, the corrected roller rotational speed W2 is assumed to be, for example, 125% of the roller rotational speed W1 upon experience. Therefore, the corrected roller rotational speed W2 is calculated by the following equation:

$$W2 = W1 \times 1.25 = 5795(\text{r.p.m.})$$

Next, setting of a frequency F (of electric current) to be supplied to the inverter 124 of the motor 31 is made as follows: The roller rotational speed W2 is represented by the following equation:

$$W2 = 120f(\text{frequency})/P = 60f$$

where P is the number of poles and therefore 2.

Accordingly, f=W2/60=97(Hz).

Here, the frequency F to be set is given by $f \times \gamma$ (coefficient corresponding to a motor load =1.1), and calculated by the following equation:

$$F = 97 \times 1.1 = 107(\text{Hz})$$

It will be understood that the weft picking system E is operated upon changing the above weaving condition and loom operational condition to seek a predetermined weft reaching time (at which the weft yarn reaches the counter-weft picking side). Then, the above set frequency F (or the rotational speed of the roller 33) at the predetermined weft reaching timing is stored as a table in the controller 120. The necessary data for obtaining the set frequency F is looked up from the table during the starting of the loom.

Subsequently, an operational manner of the weft picking system E will be discussed in connection with the set frequency F of the inverter 124 of the motor 31 for driving the roller 33 of the weft traction device 30.

First, initial values (the loom main shaft rotational speed, the weaving width, the yarn kind and the like) for operating the loom are input to the controller 120. The controller 120 computes the roller rotational speed W2 and the set frequency F. Thus, the frequency F for the inverter 124 is set. Next, the gaiting is started after looming upon a change of yarns to be woven. In the gaiting, the loom main shaft 5 is rotated at a low speed making a so-called inching since a normal tension has not been applied to the warp yarns, in which a weft yarn is inserted into the shed of the warp yarns one by one making beating-up with the reed 3. During this gaiting, several meters of a woven fabric which is not suitable for a commercial product is formed. When a normal warp yarn tension is obtained, the gaiting is terminated thereby starting a normal weaving operation. It will be understood that if a weft yarn feeding characteristic is measured during the gaiting, a weft picking condition for causing the weft yarn Y to reach the counter-weft picking side precisely at a predetermined timing can be instantly set at the starting of the loom. In this example, a weft feeding speed (at which the weft yarn flies under the influence of air stream) as the weft feeding characteristic is measured several times at the above-mentioned roller rotational speed W2 and at a roller rotational speed changed from that W2. In the case that the weft feeding speed deviates from a target value, the roller rotational speed is calculated from the weft feeding characteristics and corrected. Thereafter, the loom is started, the weft reaching timing is measured by the weft reaching sensor 100, in which the roller rotational speed is further corrected when the weft reaching timing deviates from the predetermined timing. Under such a control, a secure weft picking can be achieved.

A thirteenth embodiment of the weft picking system of the present invention is similar to the first embodiment with exception being that the controller 120 is arranged to make an operation such as to keep the roller 33 of the weft traction device 30 in a condition to be rotating when a time required until re-start of the loom is within a predetermined time, thus facilitating re-start of the loom. More specifically, when operation of the loom is stopped to put the loom operation signal at the OFF state, it is discriminated as to whether a cause of the loom stopping is mispick or not. This discrimination is made depending upon the ON or OFF state of the weft picking abnormality signal which is generated by the weft reaching sensor 100 when the picked weft yarn Y does not reach the counter-weft picking side. When the cause is discriminated to be the mispick, a long time is not required for removing the cause of the mispick and normalizing loom operation and therefore the roller rotation command signal is put at its ON state thereby to continue rotation of the roller 33 of the weft traction device 30. If the cause is discriminated not to be the mispick, for example, the cause is breakage of a warp yarn, a long time is required for normalizing the loom operation and therefore the roller rotation command signal is put at its OFF state to stop the rotation of the roller 33.

It will be understood that a weft breakage sensor (not shown) may be provided in addition to the weft reaching sensor 100, in which the mispick is discriminated to be a short pick or a weft yarn breakage. The breakage sensor is located on the further counter-weft picking side relative to the weft reaching sensor 100. In case no device for removing a broken piece of the broken yarn is provided at the counter-weft picking side, it is impossible to promptly start the loom. Accordingly, when the mispick is discriminated to be the weft yarn breakage, rotation of the roller 33 of the weft traction device 30 is stopped.

A fourteenth embodiment of the weft picking system of the present invention is similar to the thirteenth embodiment with the exception that no discrimination is made for the cause of the loom stopping. In this embodiment, even when the loom is stopped by putting the loom operation signal at its OFF state, the roller 33 of the weft traction device 30 continues to rotate because the roller rotation command signal is maintained at the ON state. However, if re-start of the loom is not made within a time of 5 minutes, normalization of loom operation is judged to require a long time and therefore rotation of the roller 33 of the weft traction device 30 is stopped by putting the roller rotation command signal at the OFF state. When the re-start is made within 5 minutes, the roller 33 is kept rotating, thereby facilitating the re-start of the loom.

What is claimed is:

1. A weft picking system for a fluid jet loom, comprising:

means for measuring a predetermined length of a weft yarn and storing it prior to a weft picking;

a weft posture regulating nozzle for regulating a posture of the weft yarn fed from said measuring and storing means and to be picked into a shed of warp yarns under influence of a fluid jet ejected from said weft posture regulating nozzle;

a weft traction device disposed between said measuring and storing means and said weft posture regulating nozzle, said weft traction device including a rotatable roller capable of making pressing contact with the weft yarn such that a traction action of said weft traction device rotatable roller on the weft yarn draws the weft yarn from said measuring and storing means to said weft posture regulating nozzle;

means for causing said weft traction device rotatable roller to always rotate at least during a weaving operation of the loom;

a change-over device which takes a first state to cause the weft yarn to be brought into pressing contact with said weft traction device rotatable roller, and which takes a second state to cause the weft yarn to separate from said weft traction device rotatable roller; and means for changing said change-over device from said second state to said first state after a starting of ejection of the fluid jet from said weft posture regulating nozzle during a weft picking cycle.

2. A weft picking system as claimed in claim 1, further comprising means for restraining the weft yarn from being picked even under a fluid jet ejection from said weft posture regulating nozzle; and means for releasing the weft yarn from restraint of said restraining means at a timing between starting of an air jet ejection from said weft posture regulating nozzle and starting of the traction action of said weft traction device thereby starting the traction action of said weft traction device after the weft yarn makes a low speed movement.

3. A weft picking system as claimed in claim 1, further comprising means for lowering a pressure of the fluid jet ejected from said weft posture regulating nozzle during the traction action of said weft traction device.

4. A weft picking system as claimed in claim 3, further comprising a plurality of sub-nozzles which are arranged along the shed of warp yarns to eject fluid jets to push the weft yarn fed from said weft posture regulating nozzle so as to accomplish the weft picking, wherein said weft picking system further comprises means for lowering the fluid jet pressure in said weft posture regulating nozzle immediately after a tip end section of the picked weft yarn has reached a sub-nozzle located nearest said weft posture regulating nozzle.

5. A weft picking system as claimed in claim 3, further comprising a plurality of sub-nozzles which are arranged along the shed of warp yarns to eject fluid jets to push the weft yarn fed from said weft posture regulating nozzle so as to accomplish the weft picking, wherein said weft picking system further comprises means for causing said sub-nozzles to eject fluid jets immediately after the fluid jet pressure in said weft posture regulating nozzle is lowered.

6. A weft picking system as claimed in claim 5, further comprising means for causing said sub-nozzles to eject air jets immediately after termination of the traction action of said weft traction device in the weft picking cycle.

7. A weft picking system as claimed in claim 1, further comprising means for setting a first change-over timing at which said change-over device is changed from the first state to the second state, and a second change-over timing at which said change-over device is changed from the second state to the first state; and means for making different said first and second change-over timings during a starting of the weaving operation of the loom from first and second changeover timings during a normal weaving operation of the loom.

8. A weft picking system as claimed in claim 1, further comprising means, at a position between said weft measuring and storing means and said weft posture regulating nozzle for providing a running resistance to the weft yarn during an initial period of the weft picking in the weft picking cycle.

9. A weft picking system as claimed in claim 1, further comprising means for setting an operational condition of at least one of said weft traction device and said change-over device in accordance with a weaving condition including a weaving width, a loom main shaft rotational speed and a kind of yarn, said weaving condition being input to said operational condition setting means.

10. A weft picking system as claimed in claim 1, further comprising means for picking the weft yarn into the shed of warp yarns during a gaiting, means for measuring operational parameters of said weft picking system for accomplishing the weft picking during the gaiting, and means for computing and setting an operational condition of at least one of said weft traction device and said change-over device in accordance with the measured operational parameters.

11. A weft picking system as claimed in claim 1, wherein said weft measuring and storing means includes an engaging pin which is operable to be engaged with the weft yarn so as to stop running of the weft yarn in the weft picking, wherein said weft picking system further comprises means for causing said engaging pin and said change-over device to be in timed relation to each other, and means for computing and setting an operational timing of one of said engaging pin and said change-over device in accordance with that of the other.

12. A weft picking system as claimed in claim 1, wherein said weft picking system is for a multiple color weaving loom and further comprises means for outputting a signal representative of command of selection of one of weft yarns to be picked, and means for operating said change-over device changing means in response to said signal.

13. A weft picking system as claimed in claim 1, further comprising means for detecting a weft reaching timing at which a picked weft yarn has reached a counter-weft picking side, and means for controlling an amount of the traction action of said weft traction device per unit time in accordance with the weft reaching timing.

14. A weft picking system as claimed in claim 1, further comprising a pipe formed with a slit extending axially and connecting opposite end openings of the pipe, said pipe being disposed between said weft measuring and storing means and said weft posture regulating nozzle and being curved around said weft traction device, means for threading the weft yarn into said pipe under the influence of fluid stream generated on an upstream side of said pipe during a weft threading for threading the weft yarn from a weft supply member to said weft posture regulating nozzle, and means for causing the weft yarn within said pipe to be moved onto a side of said weft traction device through said slit under the influence of fluid jet to draw the weft yarn, generated on a downstream side of said pipe.

15. A weft picking system as claimed in claim 1, wherein said weft traction device includes a pair of rotatable rollers which are always rotated during operation of the loom, the weft yarn being able to be put between and separated from said pair of rotatable rollers by cooperation of the changing means and the changing device, the weft yarn being put between said rollers at the first state such that it is drawn under rotation of said rollers and being separated from said rollers at the second state of said change-over device.

16. A weft picking system as claimed in claim 15, wherein said change-over device includes a traverse lever having a weft yarn guide by which the weft yarn is guided between said rollers of said weft traction device, and means for moving said traverse lever into a first position at which the weft yarn is put between said rollers and a second position at which the weft yarn separates from said rollers.

17. A weft picking system as claimed in claim 15, wherein a clearance is formed between said rollers of said weft traction device.

18. A weft picking system as claimed in claim 17, further comprising means for controlling the clearance between said rollers.

19. A weft picking system as claimed in claim 15, further comprising means for changing a frictional force of said rollers to the weft yarn in an axial direction of each of said rollers, during an initial period of the traction action of said weft traction device in the weft picking cycle.

20. A weft picking system as claimed in claim 19, wherein said frictional force changing means includes means for decreasing the frictional force in a direction from an end section to a central section of each of said rollers.

21. A weft picking system as claimed in claim 15, further comprising means for commanding rotation of at least one of said rollers before the starting of the weaving operation of the loom.

22. A weft picking system as claimed in claim 15, further comprising means for prohibiting the starting of the weaving operation of the loom until said rollers rotate sufficiently to make a predetermined traction action between said weft traction device and the weft yarn.

23. A weft picking system as claimed in claim 22, wherein said prohibiting means includes means for maintaining said rollers to rotate for a predetermined time after the weaving operation of the loom is stopped.

24. A weft picking system as claimed in claim 15, further comprising an inverter motor for driving at least one of said pair of rollers of said weft traction device, and means for changing a frequency of electric current to be supplied to said inverter motor during the starting of the loom weaving operation so as to regulate a rotational speed of the roller at a predetermined level.

25. A weft picking system as claimed in claim 24, further comprising means for detecting a rotational speed of at least one of said pair of rollers during the weaving operation of the loom, and means for correcting said frequency in response to said rotational speed.

26. A weft picking system for a fluid jet loom, comprising:

means for measuring a predetermined length of a weft yarn and storing it prior to a weft picking;

a weft posture regulating nozzle for regulating a posture of the weft yarn fed from said measuring and storing means and to be picked into a shed of warp yarns under influence of a fluid jet ejected from said weft posture regulating nozzle;

a weft traction device disposed between said measuring and storing means and said weft posture regulating nozzle, said weft traction device including a rotatable roller capable of making pressing contact with the weft yarn such that a traction action of said weft traction device rotatable roller on the weft yarn draws the weft yarn from said measuring and storing means to said weft posture regulating nozzle;

means for causing said weft traction device rotatable roller to always rotate during a weaving operation of the loom;

a change-over device which takes a first state to cause the weft yarn to be brought into pressing contact with said weft traction device rotatable roller, and which takes a second state to cause the weft yarn to separate from said weft traction device rotatable roller;

means for changing said change-over device from said second state to said first state after starting of ejection of the fluid jet from said weft posture regulating nozzle during a weft picking cycle;

means for outputting a loom stop signal by which the weaving operation of the loom is stopped; and means for maintaining said change-over device at the second state, in response to said loom stop signal.

27. A weft picking system as claimed in claim 26, further comprising a failed-weft yarn removing device for removing a weft yarn failed in weft picking and located in the shed of warp yarns, and means for detecting that output of the loom stop signal is due to failure in weft picking, wherein said weft picking system further comprises means for operating said failed-weft yarn removing device to remove the failed weft yarn while maintaining said change-over device in the second state in response to said detecting means detecting that output of the loom stop signal is due to failure in weft picking.

* * * * *